US006328630B1

(12) United States Patent
Jinbo et al.

(10) Patent No.: US 6,328,630 B1
(45) Date of Patent: Dec. 11, 2001

(54) EYEGLASS LENS END FACE MACHINING METHOD

(75) Inventors: Masahiro Jinbo; Takashi Daimaru, both of Tokyo (JP)

(73) Assignee: Hoya Corporation, Tokyo (JP)

( * ) Notice: Subject to any disclaimer, the term of this patent is extended or adjusted under 35 U.S.C. 154(b) by 0 days.

(21) Appl. No.: 09/411,323

(22) Filed: Oct. 4, 1999

(30) Foreign Application Priority Data

Oct. 5, 1998 (JP) ..... 10-282681
Oct. 6, 1998 (JP) ..... 10-284048

(51) Int. Cl.[7] ..... B24B 49/00; B24B 1/00
(52) U.S. Cl. ..... 451/11; 451/41; 451/42; 451/43; 451/44
(58) Field of Search ..... 451/43, 42, 5, 451/8, 9, 10, 11, 41, 44

(56) References Cited

U.S. PATENT DOCUMENTS 3,353,303 * 11/1967 Stern ..... 451/43
3,520,091 * 7/1970 Raphael ..... 451/43

(List continued on next page.)

FOREIGN PATENT DOCUMENTS

4012658 * 9/1991 (DE) ..... 451/43
0 297 993 A2 1/1989 (EP) .
0 826 459 A1 3/1998 (EP) .
0 857 540 A2 8/1998 (EP) .
64-87144 3/1989 (JP) .
4372352 * 12/1992 (JP) ..... 451/43
5111864 * 5/1993 (JP) ..... 451/43
639696 * 2/1994 (JP) ..... 451/43
24273 * 12/1993 (WO) ..... 451/43

*Primary Examiner*—M. Rachuba
(74) *Attorney, Agent, or Firm*—Oliff & Berridge, PLC

(57) ABSTRACT

The following was done in order to mechanically polish a bevel face after bevel finishing without manually polishing and thereby speed up the polishing process and improve uniformity of finishing precision, as well as obtain fashionable eyeglasses: That is, a polishing wheel for polishing a bevel with a bevel polishing groove the shape of which essentially matches the bevel faces of the finished lens is used. The bevel is polished in two processes using said wheel. During the first process, the apex position of the bevel in the finished lens is displaced from the bevel-groove center position of the bevel polishing groove in the wheel to the concave side of the lens and the polishing allowance on the concave side of the bevel faces is polished. During the second process, the bevel apex position is displaced to the lens convex side so that the bevel apex position of the finished lens and the center position of the bevel-groove in the wheel match and the polishing allowance on the convex side and from the polishing irregularities that remained after the first polishing process is polished.

Moreover, the following was done in order to prevent streaks from being made in the lens by the wheel when the planed end face of the eyeglass lens is polished to a mirror polish; That is, the eyeglass lens, one side of which is convex and the opposite side of which is concave, is pressed to the bevel polishing wheel, which has a bevel polishing groove the shape of which corresponds to the bevel and a polishing face, and the smooth face is polished to a mirror polish. The position of the eyeglass lens in the direction of the X axis is controlled during machining of the and face using the polishing face of the wheel so that the apex position of the end face on the convex side of the eyeglass lens where the surface on the convex side of the eyeglass lens and the end face intersect is the usually the boundary between the flanks that are in series with the bevel polishing groove and the planing and polish face that is in series with said flanks.

17 Claims, 14 Drawing Sheets

U.S. PATENT DOCUMENTS

| | | | | |
|---|---|---|---|---|
| 4,286,415 | * | 9/1981 | Loreto | 451/43 |
| 4,300,317 | * | 11/1981 | Croft et al. | 451/43 |
| 4,383,393 | | 5/1983 | Takubo . | |
| 4,612,736 | | 9/1986 | Massard et al. . | |
| 4,870,784 | * | 10/1989 | Ramos et al. | 451/43 |
| 4,908,996 | * | 3/1990 | Friedman et al. | 451/43 |
| 5,149,337 | * | 9/1992 | Watanabe | 451/43 |
| 5,161,333 | * | 11/1992 | Lecerf et al. | 451/43 |
| 5,630,746 | * | 5/1997 | Gottschald et al. | 451/43 |
| 5,643,052 | * | 7/1997 | Delattre et al. | 451/43 |
| 5,711,700 | * | 1/1998 | Rafaelli | 451/43 |
| 5,993,295 | * | 11/1999 | Raffaelli | 451/43 |

* cited by examiner

Flow chart

EYEGLASS LENS END FACE MACHINING METHOD

BACKGROUND OF THE INVENTION

1. Field of the Invention

The present invention pertains to an eyeglass end face machining method, particularly to the polishing to a mirror polishing that is performed on the end face after bevel edging, or the planing, such as machining to a mirror polishing, that is performed on the end face after edging.

2. Description of the Related Art

The lens end face of rimless eyeglasses lenses usually referred to as three-piece eyeglass lenses is exposed and not covered by a rim, etc., and therefore, they must have a surface that has been polished until glossy. In response to this need, technology has been presented whereby eyeglass lenses, whose end face has thus far been smoothed manually in order to obtain a face that has been polished until glossy, are mechanically polished by placing a movement mechanism with tracing capability in the polishing wheel part (for instance, Japanese Patent Laid-Open No. Sho 64-87144). This grinds inclined faces, such as the end face of polyhedron cut lenses, etc., and although the shape around the eyeglass lens is complex because of the polyhedron cut, the end face itself, which becomes the surface to be grounded, is a flat surface and simple. Consequently, the above-mentioned technology cannot be used when the surface to be polished itself has a complex shape, such as lens end faces with a bevel. Now, because the lens end face with a bevel is usually concealed by the rim of the frame and there is no need to polish the bevel faces, a lens end face with a bevel itself is usually not polished.

However, there has been a demand in recent years for thin rims in order to obtain frames that are more lightweight and fashionable, etc., and it is often the case that if the lens fitted into the rim is a strong-minus-power lens with a thick edge, the lens will protrude from the rim of the frame. It is pointed out that the bevel faces remains white when polishing of the lens end face is completed by bevel-polishing and this poses a problem aesthetically. Polishing the bevel surface that remains white until it is transparent is only accomplished by buff polishing the bevel surface by hand, etc., and this takes time and increases cost.

The objective of the present invention is to solve the above-mentioned problems with prior art by mechanically polishing the bevel faces in 2 steps and to present a lens end face machining method, wheel and device for eyeglass lens end face machining with which it is possible to speed up the polishing process and make finishing precision uniform and obtain fashionable eyeglass.

Moreover, in addition to the aesthetic problem of the lens end face remaining white after bevel polishing that was previously described, there is a problem with polishing precision and fashionable eyeglasses in that when planing, such as smooth machining and machining to a mirror polishing etc., is performed with a wheel that has a bevel-groove and a planing face, streaks are made. That is, cylindrical grinding stone called diamond wheels(stone) have a bevel-groove for formation of a bevel at the end face of the eyeglass lens and a flat face for flat machining the end face of an eyeglass lens. In further detail, the wheel has groove inclined face 301 for V finishing having a specific angle with respect to the axial direction called angle No. 1, flank 203 for the eyebrow of the frames continuous with this groove inclined face 301 having a specific angle with respect to the axial direction referred to as angle No. 2 that is smaller than angle No. 1, and flat finishing face 303 continuous with this flank 302 for flat machining and parallel to the axial direction on the surface around the periphery of the wheel. The inclination at boundary K between above-mentioned flank 302 and flat finishing face 303 is not continuous.

Consequently, when an eyeglass lens moves past boundary K to the left in the direction of the X axis during flat machining, apex A of the end face of eyeglass lens 6 straddles boundary K and a streak from boundary K is made in end face 6*a* of eyeglass lens 6. When a streak is made in end face 6*a* of the eyeglass lens, edging precision drops and becomes non-uniform, and the product is not fashionable. Therefore, such a streak is undesirable. This is particularly a problem with flat finished surfaces that remain white and are further given a mirror finish so that they are transparent.

Thereupon, in order to solve this problem, flat finishing face 303 is made longer in the axial direction so that even if eyeglass lens 6 moves to the left in the direction of the X axis during flat edging, it will not pass boundary K. However, there is a problem in that as a result, wheel 1 is larger.

Inerdentally there is a demand for mechanical polishing of the bevel face that remains white using a wheel as a means of solving the above-mentioned aesthetic problem of the lens end face remaining white after bevel polishing because buffing, etc., manually takes time and increases cost. However, there is also a problem when a polishing wheel is used with the existing wheel in that the device becomes bigger.

The objective of the present invention is to solve the above-mentioned problems of prior art and present an eyeglass lens end face matching method with which polishing precision is uniform, the product is excellent in terms of being fashionable, and the device can be reduced in size. Another objective of the present invention is to present an eyeglass end face machining method with which it is possible to add a polishing wheel that can give the eyeglass lens end face a mirror polish without greatly increasing length of the wheel in the axial direction.

SUMMARY OF THE INVENTION

The first invention is an eyeglass lens end face machining method, comprising the steps of polishing one inclined face of the bevel formed in the end face of an eyeglass lens using a wheel for bevel polishing with inclined faces that essentially match the inclined faces of above-mentioned bevel and polishing the other inclined face of above-mentioned bevel that remains by this polishing.

The fact that the wheel for bevel polishing has an inclined face that essentially corresponds to the inclined face in the bevel formed in the end face of the eyeglass lens is not limited to the case where the two inclined faces of the bevel are continuous at the apex of the bevel and also includes the case where the two inclined faces have a space in between. Moreover, the inclined face corresponding to the inclined face of the bevel is not limited to only the inclined face of the bevel and also includes a flat area that is continuous with the bevel. Consequently, there are cases where there is a flat part continuous with the notch at one inclined face and the other inclined face of the bevel.

The inclined face of the bevel is not transparent and remains white when the end face of the eyeglass lens has been bevel-polished. Therefore, the inclined face of the bevel is ground with a wheel having inclined faces corresponding to the bevel by a first and a second process. By means of the first process, one inclined face of the wheel is pressed against one inclined face of the bevel and one inclined face of the bevel is polished. By means of the second process, the other inclined face of the bevel and polishing irregularities that remain after the first process are polished using the other inclined face of the wheel. In this case, polishing is performed so that the apex of the bevel after polishing returns to the same position as before polishing. When both inclined faces of the bevel are polished in this way, the inclined faces of the bevel that remained white are given a mirror polish and are transparent. Consequently, even if the bevel face of the eyeglass lens protrudes from the thin film of a metal frame, or even if the bottom half of the eyeglass lens is completely exposed, as with rimlon type frames, aesthetics can be maintained. Moreover, the bevel face is given a mirror finish mechanically using a wheel and therefore, polishing can be completed in a short amount of time and cost can be reduced.

Thus, by means of the first invention, the bevel is polished in 2 steps so that there is no polishing residue and therefore, mechanical polishing with a wheel can be easily realized. Moreover, it is possible to give a mirror polish using a wheel, treatment speed can be increased and uniformity of finished precision can be expected when compared to buff polishing, etc., by hand. Furthermore, aesthetics can be maintained, even at the bevel face of the eyeglass lens, and therefore, results are obtained in that fashionable eyeglass can be realized.

The above-mentioned wheel of the first invention is used for end face machining of eyeglass lenses where one side is convex and the other side is concave and it has in its axial direction a bevel-groove, which is formed by inclined faces that have an angle of inclination with respect to the vertical line drawn to the axis of said wheel that is referred to as angle No. 1 and which polishes said bevel at said inclined faces, and flanks, which are formed continuous with the inclined faces of said bevel-groove on the outside of said bevel-groove and which have an angle of inclination with respect to the vertical line drawn to the axis of said wheel that is referred to as angle No. 2 and is larger than said angle No. 1.

Angle No. 2 is formed in a bevel shape. This is for forming the recess to match the top rim(hood) part in the horizontal surface of the end face other than the bevel in the case of frames with a large (deep) top rim part such as combination frames (where a plastic top rim part is attached to the top rim part of a metal frame).

Thus, results are obtained in that the top rim part can be efficiently attached to the metal from when a flank with angle No. 2 greater than angle No. 1, which is the angle of the inclined face of the groove on the outside of the bevel-groove, is formed so that the top rim part of the metal frame does not touch the surface around the bevel.

When the above-mentioned wheel with a bevel-groove and flanks is used in the first invention, it is preferred that the above-mentioned flank(a non-interfering area) positioned on the concave side of the above-mentioned eyeglass lens be wider than width in the axial direction of the wheel of the above-mentioned flank positioned on the convex side of the above-mentioned eyeglass lens with respect to the above-mentioned bevel groove. When width of the flank that is on the concave side of the eyeglass lens is wider than the width of the flank on the convex side of the eyeglass lens, the present invention can be used for strong minus power lenses that have a thick end face.

The second invention is an eyeglass lens end face machining method for polishing the bevel in the end face of an eyeglass lens comprising first moving the apex position of the bevel on the eyeglass lens end face from the base position (deepest part) in the bevel-groove of the wheel to the back side of the eyeglass lens and polishing the machining allowance using a wheel for bevel polishing with a bevel-groove the shape of which matches said bevel and then returning the eyeglass lens to its original position so that the apex position of the bevel in the end face of the eyeglass lens approximately coincides with the base position of the bevel-groove in said wheel and polishing the polishing allowance that remains on the bevel front side of the eyeglass lens end face and machining the bevel end face of said eyeglass lens to a mirror polish.

The above-mentioned polishing allowance on the back of the eyeglass lens end face that was originally polished is not limited to only the back side of the end face of the eyeglass lens and also includes cases of polishing allowance on the front side of the eyeglass lens end face.

When the position of the apex of the bevel in the eyeglass end face is displaced from the base position in the bevel-groove of the wheel to the back side of the eyeglass lens and the wheel and eyeglass lens are relatively adjacent to one another, the back of the eyeglass lens will touch the inclined face on the same side on the wheel surface as the back side of the eyeglass lens before it touches the front side of the eyeglass lens and therefore, the polishing allowance on the back side of the eyeglass lens will be polished first. Moreover, when the eyeglass lens returns to its original position and the apex position of the bevel in the eyeglass lens approximately coincides with the base position of the bevel-groove in the wheel, at that time the front side of the eyeglass lens will touch the inclined face on the same side of the wheel surface as the front side of the eyeglass lens before it touches the back side of the eyeglass lens and therefore, the remaining polishing allowance on the surface of the eyeglass lens is polished. The white bevel-shaped face on both the front and back of the eyeglass lens is made transparent by this polishing.

Furthermore, that the apex position of the bevel in the end face of the eyeglass lens "approximately coincides" with the base position of the bevel-groove in the above-mentioned wheel when the polishing allowance that has been cut with the bevel faces of the end face of the eyeglass lens is polished includes not only the case where they coincide perfectly, but also the case where the amount by which the eyeglass lens is displaced is corrected so that it is displaced slightly away from the point where they coincide perfectly, as will be described later.

By means of this second invention, results are obtained in that the bevel face at the back and the bevel face at the front of the eyeglass lens are cut in 2 steps, with the apex of the bevel in the eyeglass lens serving as the boundary between the two faces, and therefore, the bevel can be polished to a mirror polish while retaining the finished shape of the bevel and the apex position of the bevel.

It is preferred in the second invention that particularly when the above-mentioned eyeglass lens is a hard lens with poor edging performance made from polycarbonate type, etc., pressure be firmly applied to the face of the above-mentioned wheel so that the apex position of the bevel in the above-mentioned eyeglass lens end face is displaced slightly away from the point where it perfectly matches the base position of the bevel-groove of the wheel toward the front of the eyeglass lens when the remaining polishing allowance is ground with the front of the above-mentioned eyeglass lens end face.

When the eyeglass lens is a lens of good edging performance, such as a plastic lens made from the allyl type resin of diethylene glycol allyl type carbonate (referred to below as a DEC lens), there is no problem with bringing the apex position of the bevel of the eyeglass lens so that it matches the base position of the bevel-groove in the wheel and polishing when the polishing machining allowance is polished with the front of the eyeglass lens. However, if the eyeglass lens is a lens with poor edging performance made of polycarbonate(type), the bevel face of the bevel on the front side of the eyeglass lens will hit the wheel surface with force and therefore, there will be some problems with polishing. Therefore, the amount by which the eyeglass lens is displaced is corrected so that the apex of the bevel in the eyeglass lens is displaced away from the point where it coincides with the base position in the bevel groove of the wheel slightly toward the front side of the eyeglass lens and firmly hits the above-mentioned wheel surface. Optimum mirror polishing is possible, even if the eyeglass lens is made from a material with poor edging performance, when the amount by which the eyeglass lens is displaced is corrected for the type of material used for this eyeglass lens and the force with which the eyeglass lens hits the wheel is thereby adjusted.

Moreover, it is preferred in the first and second inventions that relative movement of the above-mentioned eyeglass lens with respect to the above-mentioned wheel be accomplished by moving the above-mentioned eyeglass lens. This movement of the eyeglass lens with respect to the wheel can be accomplished by moving the wheel as well, but movement of the eyeglass lens as in the present invention provides a simpler device structure. By means of this structure, the eyeglass lens is moved and therefore, existing technology can be used as is and the device structure can be simplified.

Furthermore, there are no particular restrictions to the wheel that is preferably used for the first and second invention, and the following type is given. That is, it is a wheel wherein a rough edging wheel for rough edging the end face of the eyeglass lens, a bevel finishing wheel that forms a bevel in the end face of the above-mentioned eyeglass end face, and a polishing wheel that gives a mirror polish to the end face of the above-mentioned eyeglass lens are placed as one unit on the same axis, and the above-mentioned bevel finishing wheel and above-mentioned polishing wheel have a bevel-groove in their surfaces the shape of which corresponds to the above-mentioned bevel, flanks that are formed on both sides of the above-mentioned bevel-groove, and a planing face continuous with the flank of the above-mentioned flanks that is at the back side of the eyeglass lens. The bevel-groove is a bevel finishing groove in the bevel finishing wheel and a bevel polishing groove in the polishing wheel. The planing face is a smooth finishing face in the notch-finishing wheel and a smooth polishing face in the polishing wheel.

When the end face of the eyeglass lens is finished, the series of processes are performed whereby the end face of the eyeglass lens is rough edg, the bevel-shape is formed in this rough edg surface, and the inclined faces of the bevel shape that has been formed are given a mirror polish by moving the eyeglass lens in the axial direction of the wheels in succession to the rough edging wheel, bevel finishing wheel, and polishing wheel.

It is preferred in the third invention that the diameter of each wheel, the above-mentioned rough edging wheel, bevel finishing wheel and polishing wheel, that are one unit on the axis of the above-mentioned wheel, be approximately the same and particle diameter of each wheel be changed in order to match the function of each wheel during each process of rough edging, smoothing, bevel finishing and mirror polishing.

Each of the above-mentioned inventions are inventions relating to mirror polishing and smooth machining of the end face after giving a bevel-finish to the end face and they mainly are inventions for solving the aesthetic problem of the end face of the lens that remains white after the bevel has been finished, but the inventions that follow relate to planing of the end faces by smooth machining and mirror polishing, etc., and are mainly for the problems of finishing precision and fashionable eyeglasses that accompany streak formation with planing and the large size of the device.

The third invention is an eyeglass lens end face matching method comprising the step of pressing the eyeglass lens to a wheel with at least a planing face and machining the end face of the eyeglass lens, wherein during machining of the end face using the planing face of said wheel, the position of the eyeglass lens in the direction of the X axis is controlled so that the edge of the end face of said eyeglass lens usually will not pass the reference position on said wheel. "The wheel with a planing face" is a smooth machining wheel, a polishing wheel with a polishing face that further polishes to a mirror polish the smooth face that has been machined, further, a wheel that is a combination of a smooth finishing wheel and a polishing wheel. The word "at least" is used and therefore, it includes the case where there is another structural element, such as a bevel-groove the shape of which corresponds to the bevel or flanks that join with this, etc., or the case where there are no other such structural elements, as long as the wheel has a planing face. When the edge of the end face of the eyeglass lens is thus controlled so that it usually does not pass the reference position on the wheel it is not necessary to give the wheel extra width when compared to the case where such control is not used and therefore, a smaller wheel can be expected. Moreover, the eyeglass lens is controlled so that only the end face of the eyeglass lens is pressed to the planing face and it does not pass a reference position on the wheel and therefore, there are no streaks made in the end face of the eyeglass lens. Consequently, results are obtained in that finishing precision is uniform and the eyeglass lens is more fashionable.

Moreover, an eyeglass lens where one of the surfaces is a convex surface and the opposite surface is a concave surface is an example of the above-mentioned eyeglass lens for which the third invention is ideal. The edge of the end face of the above-mentioned eyeglass is at the apex of the end face on the convex side of the eyeglass lens where the surface on the convex side of the above-mentioned eyeglass lens intersects with the end face. When the end face of an eyeglass lens with this shape is machined, there are times when the position of the apex of the end face on the convex side of the eyeglass lens is not consistent throughout machining because one surface is convex and therefore, it is particularly necessary in this case to control the position of the eyeglass lens in the direction of the X-axis by the third invention.

in addition, it is preferred that when the third invention is used for an eyeglass lens where one side is convex and the opposite side is concave, the above-mentioned eyeglass lens be turned around the lens axis and the position of the above-mentioned eyeglass lens in the direction of the X axis be controlled by correcting the apex position of the end face on the convex side of the above-mentioned eyeglass lens, which changes with the above-mentioned turning, so that it usually coincides relatively with the reference position on the above-mentioned wheel in synchronization with the above-mentioned turning during machining of the end face of the above-mentioned eyeglass lens.

It is possible to press only the eyeglass lens end face against the planing face, and therefore, no streaks will be made in the eyeglass end face, even in the case where the eyeglass lens is being turned as the end face is being machined, as long as the position of the eyeglass lens in the direction of the X axis is being controlled in synchronization with the turning of the eyeglass lens. Consequently, finishing precision is uniform and the eyeglasses are more fashionable. Furthermore, since the position where the eyeglass lens is pressed against the planing face is fixed and does not move, it is not necessary to give the planing face extra width and as result, it is possible to reduce the length of the wheel in its direction of width.

Furthermore, the third invention can be used even when the above-mentioned wheel has only the above-mentioned planing face and in this case, the reference position on the above-mentioned wheel can be the end of the above-mentioned planing face.

Moreover, the third invention can also be used when the above-mentioned wheel has a bevel-groove the shape of which corresponds to the bevel and the above-mentioned planing face continuous with one another. In this case, the reference position on the above-mentioned wheel can be the boundary position between the above-mentioned bevel-groove and the above-mentioned planing face.

In such a case, the position of the eyeglass lens in the direction of the X axis is controlled so that the end face of the eyeglass lens is pressed against only the planing face and it does not come into contact with the bevel-groove and therefore, there are no streaks from the boundary between the bevel-groove and the planing face on the end face of the eyeglass lens. Consequently, finishing precision is uniform and the eyeglass lens is more fashionable.

Furthermore, the third invention can also be used when the above-mentioned wheel has a bevel-groove the shape of which corresponds to the bevel, flanks continuous with this bevel-groove, and the above-mentioned planing face continuous with these flanks, and in this case, the reference position on the above-mentioned wheel can be the boundary position between the above-mentioned flanks and the above-mentioned planing face.

in such a case, the end face of an eyeglass lens does not pass the boundary position between the flanks and the planing face and does not touch the flanks and therefore, there are no stripes from this boundary, even if the angle of inclination between the flanks and planing face is discontinuous.

The following is given as an example where the above-mentioned wheel in the third invention has a bevel-groove and flanks and a planing face.

First, a first example is the case where the above-mentioned wheel has a bevel finishing wheel that finishes the end face of the above-mentioned eyeglass lens, the above-mentioned bevel-groove is a bevel finishing groove, and the above-mentioned planing is a smooth finishing face.

Next, a second example is the case where the above-mentioned wheel is a polishing wheel that gives a mirror polish to the finished end face of the above-mentioned eyeglass lens, the above-mentioned bevel-groove is a bevel polishing groove, and the above-mentioned planing face is a smooth polishing face.

A third example is the case where the above-mentioned wheel has a bevel finishing wheel that finishes the end face of the above-mentioned eyeglass lens and a polishing wheel that gives a mirror polishing to the finished end face of the above-mentioned eyeglass lens as one unit on the same axis, wherein these bevel finishing wheels and polishing wheels each have the above-mentioned bevel-groove, the above-mentioned flanks, and the above-mentioned planing face and the above-mentioned bevel groove of the above-mentioned bevel finishing wheel is a bevel finishing groove, the above-mentioned planing face of the above-mentioned bevel finishing wheel is a planing face, the above-mentioned bevel-groove in the above-mentioned polishing wheel is a bevel polishing groove, and the above-mentioned polishing face of the above-mentioned grinding wheel is a smooth polishing face.

Moreover, by means of the third invention, the above-mentioned wheel has a bevel groove, flanks, and a planing face and therefore, the case of an eyeglass lens where one side is convex and the opposite side is concave and the edge of the end face of the above-mentioned eyeglass lens is the apex position of the end face on the convex side of the eyeglass lens where the surface on the convex side of the above-mentioned eyeglass lens intersects the end face can be given as an example of an eyeglass lens for which the third invention is ideal.

in this case, it is preferred that when the end face of the above-mentioned eyeglass lens is finished, the above-mentioned eyeglass lens be turned around the lens axis and the above-mentioned eyeglass lens be controlled in the direction of the X axis in synchronization with the above-mentioned turning while correcting the position of the apex of the end face on the convex side of the above-mentioned eyeglass lens, which changes with the above-mentioned turning, so that it usually relatively coincides with the reference position on the above-mentioned wheel.

In such a case, the apex position of the end face on the convex side of the eyeglass lens is usually the boundary position between the flanks and the smoothing faces of the wheel and the position at which the eyeglass lens is pressed to the smoothing face is fixed and does not move and therefore, it is not necessary to give the smoothing face extra width. As a result, it is possible to make the wheel shorter in the direction of width.

Furthermore, by means of the third invention, it is possible to form the above-mentioned bevel-groove of the above-mentioned wheel using inclined surfaces with an angle with respect to the axis of the above-mentioned wheel referred to as supplementary angle No. 1 when the above-mentioned wheel has a bevel-groove, flanks and a planing face, with the above-mentioned flanks of the above-mentioned wheel being joined to the inclined faces of the above-mentioned bevel-groove and having an angle o f inclination with respect to the axis of the above-mentioned wheel called supplementary angle No. 2 that is smaller than above-mentioned supplementary angle No. 1, and the above-mentioned planing face of the above-mentioned wheel being joined to the above-mentioned flanks and having an angle of inclination with respect to the axis of the above-mentioned wheel referred to as supplementary angle No. 3 that is smaller than above-mentioned supplementary angle No. 2.

In such a case, in addition to the fundamental results of controlling the position of the eyeglass lens in the direction of the X axis of the third invention, no strips are made in the end face of the eyeglass lenses even if, for instance, the eyeglass lens end face is at the boundary between the flanks and the planing face (although this is fundamentally impossible because the position of the eyeglass lens in the direction of the X axis is controlled) because although the angle of inclination between the flank and the planing is discontinuous, the planing face is iinclined close to the angle of inclination of the flanks and is not parallel to the axis of the wheel. Consequently, the lenses are more fashionable.

Moreover, by means of the above-mentioned third invention, the above-mentioned bevel-grooves of the above-mentioned bevel finishing wheel and above-mentioned polishing wheel can be formed from inclined faces with an angle with respect to the axis of the above-mentioned wheels referred to as supplementary angle No. 1, with the respective above-mentioned flanks of the above-mentioned bevel finishing wheel and above-mentioned polishing wheel being continuous with the inclined faces of the above-mentioned bevel-groove and having an angle of inclination with respect to the axis of the above-mentioned wheel that is referred to as supplementary angle No. 2 and is smaller than above-mentioned supplementary angle No. 1 and the respective above-mentioned planing faces of the above-mentioned V finishing wheel and the above-mentioned polisihing wheel being continuous with the above-mentioned flanks and having an angle of inclination with respect to the axis of the above-mentioned wheel that is referred to as supplementary angle No. 3 and that is smaller than above-mentioned supplementary angle No. 2.

In such a case, the width of the wheel can be narrower and therefore, a polishing wheel for bevel grinding can be used in series with the bevel finishing wheel, even if the wheel is not wide.

DESCRIPTION OF THE PREFERRED EMBODIMENTS

Preferred embodiments of the present invention are described below

Figure 3:
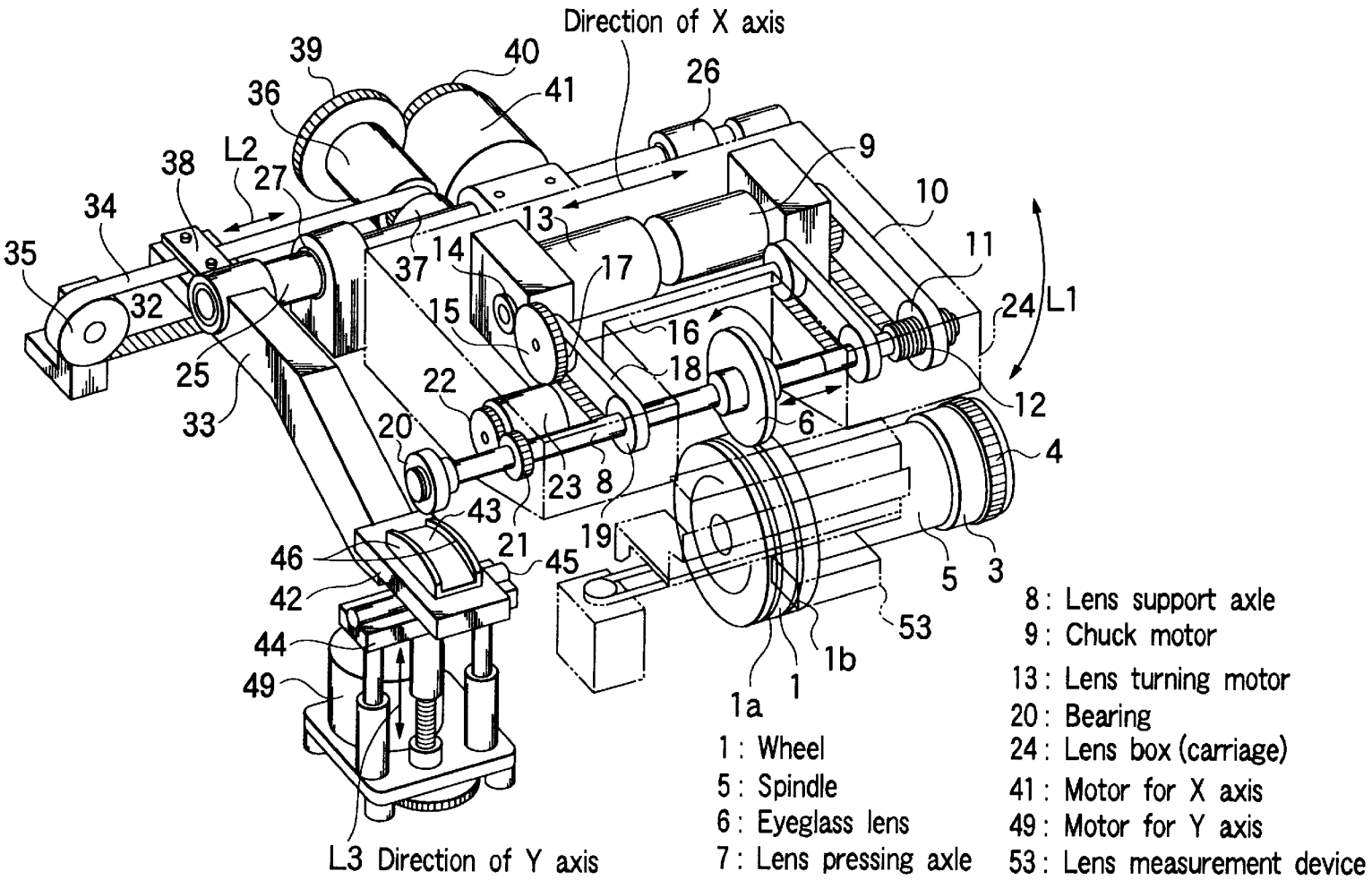
FIG. 3 is an oblique view showing the structure of the main parts of the device for machining the end face of an eyeglass lens from an aspect of an embodiment.
Figure 4:
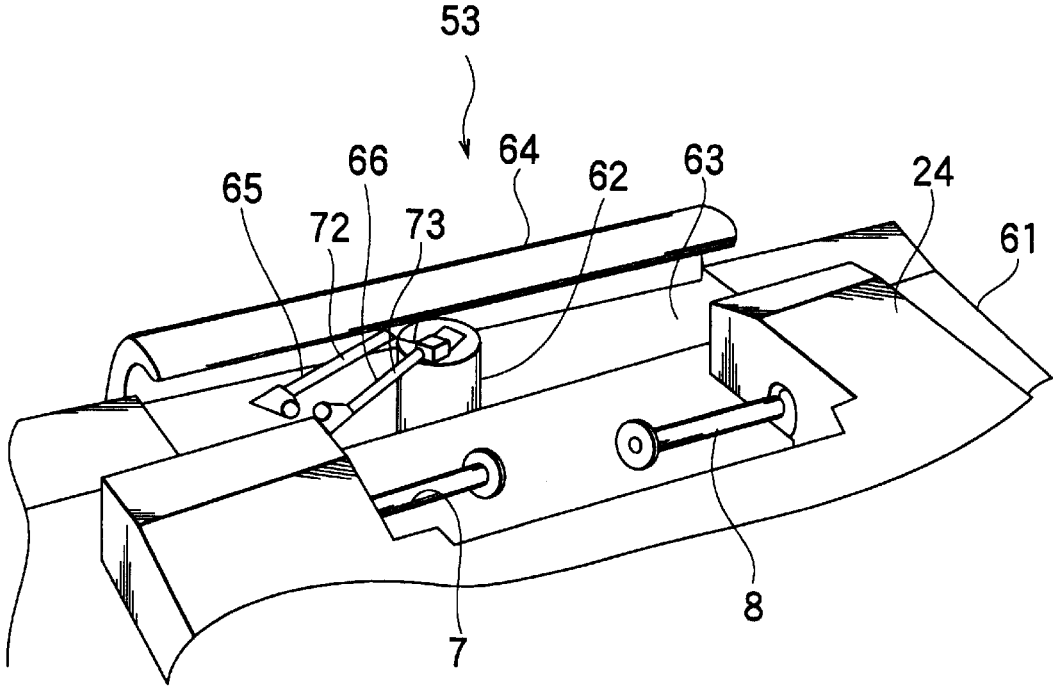
FIG. 4 is an oblique view of the device for measuring the lens circumference from an aspect of an embodiment.

FIG. 3 shows an oblique view of the main parts of the internal structure of a device for machining the end face of an eyeglass lens in order to conduct the method of machining the end face of an eyeglass (or Spectacle) lens of the present invention, or a so-called diamond polishing device. In FIG. 3, wheel 1, which is a turning edging diamond wheel, transmits motive power with a power transmission mechanism of pulley 3 and belt 4 using a motor for turning the wheel that is not illustrated, Eyeglass lens 6 is pressed to wheel 1 that is turned with spindle 5 and eyeglass lens 6 is cut. Eyeglass lens 6 is held in several places by lens push axle 7 and lens support axis 8 (as shown in FIG. 4). Lens push axle 7 transmits turning of chucking motor 9 via belt 10 and pulley 11 and can be moved in its axial direction by turning feed screw 12. Thus, eyeglass lens 6 is detachable.

Turning of eyeglass lens 6 is accomplished by synchronized turning of lens push axle 7 and lens support axle 8. When interlocking axis 16 is turned by motor 13 for turning the lens and gears 14 and 15, lens push axle 7 and lens support axle 8 are turned via pulley 19 by the motive power transmission mechanism of pulleys 17 at both ends of this interlocking axle 16 and belt 18 wrapped around these pulleys. The form that gives the lens pattern (not illustrated; the form is attached to where there is a bearing 20) and unfinished round eyeglass lens 6 are placed on the respective ends of lens support axle 8. Lens support axle 8 is interlocked with encoder 31 through gears 21 and 22 and as a result, the turning angle of lens support axis 8 is measured from this.

Reference 24 is the carriage(lens box). Carriage 24 holds above-mentioned motors 9 and 13 and their related movement transmission mechanisms, lens push axle 7 and lens support axle 8. Eyeglass lens 6 is placed in the middle of the depression formed in the front of carriage 24. Carriage 24 is lowered by swinging the circumference of slide axle 25 in the direction shown by arrow L1 so that eyeglass lens 6 is pushed against wheel 1 by the dead weight of carriage 24 and edged. Slide axle 25 is supported so that it can turn and so that it can slide in the axial direction by slide bearings 27, which are respectively held by two bearing cradles 26.

Bearing 32 at the right end of slide 25 in the figure slips over slide bearing 25 so that it can turn around slide axle 25 and this bearing 32 is supported by arm 33 near its back end. Belt 34 is spread parallel to slide axle 25 between pulley 35 and pulley 37 of magnetic clutch 36. Belt 34 is supported at the back end of arm 33 by support plate 38. Magnetic clutch 36 interlocks with X axis motor 41 via gears 39 and 40. Based on this structure, slide axle 25 and carriage 24 are moved in the axial direction of slide axle 25, that is, the direction of the X axis (horizontal direction) as shown by arrow L2, by operating X axis motor 41.

Support table 42 is supported near the front end of arm 33 and profiling plate 43 with the same curvature radius as wheel 1 is supported by this support table 42. (However, curvature is not necessarily the same with a patternless edger where the profiling plate has the structure of a bearing.). Above-mentioned arm 33 moves and therefore, roller 45 is placed between ramp 44 of the support mechanism, which is placed underneath to hold support table 42, and support table 42 so that support table 42 will slide over ramp 44 with roller 45.

Moreover, 49 in FIG. 3 is the Y axis motor in the direction of the Y axis (vertical direction), as shown by arrow L3, and ramp 44 can be raised and lowered in the vertical direction by operating Y axis motor 49. When ramp 44 is raised or lowered, carriage 24 can be moved around slide axle 25, as shown by arrow L1 by arm 33 and slide axle 25.

In the above-mentioned, carriage 24 is moved in the horizontal direction by X axis motor 41 and in the vertical direction by Y axis motor 49. Thus, it is possible to change as necessary the position of eyeglass lens 6, which is the object to be machined, in the horizontal direction and to bring eyeglass lens 6 into contact with or away from wheel 1 by moving carriage 24 in the horizontal or vertical direction.

Wheel 1 has a cylindrical shape and is formed with its circumferential face serving as the lens edging surface. Part of the circumferential face for edging of wheel 1 is a edging surface for lens rough machining, or bevel-groove 1*a* is made continuous with the edging surface for lens rough machining. This V-groove 1*a* is the part that is used to form the bevel in the lens end face after rough machining. Furthermore, bevel-groove 1*b*, which is used when the lens end face is polished to a mirror polish after formation of the bevel, is made in the other part. The shape data of these wheels is used as machining data.

Furthermore, the above-mentioned lens polishing device can automatically trace the shape of the frame, as will be described later, and therefore, Y axis motor 49 can be driven separately even if machining is not performed using a form or profiling plate 43 (pattern). That is, this lens polishing device can be used as a patternless machining device or a pattern machining device.

FIG. 4 shows lens edge measurement device 53. This is a device that measures the lens edge thickness, shape data, etc., of the edge of eyeglass lens 6, and this figure is an oblique view showing the state where movable door 64 of measuring instrument receptacle 63 is open. In FIG. 3, 53 of this lens edge measurement device is in front of the depression in the front of carriage 24 and is shown by the imaginary lines (two-dot chain line) above wheel 1. First and second probes 65 and 66, which come into contact with the front and the back respectively, of an eyeglass lens, one side of which is convex and the other side of which is concave, are supported by freely turning arms 72 and 73, respectively, at the top end face of axle 32, which moves up and down inside receptacle 63. The figure shows each arm turned out and probes 65 and 66 held inside measuring instrument receptacle 63. By means of this lens polishing device, the measuring instruments are placed outside carriage 24 and therefore, it is possible for lens edge measurement device 53 to be unaffected by shaking when the lens is being polished.

Figure 5:
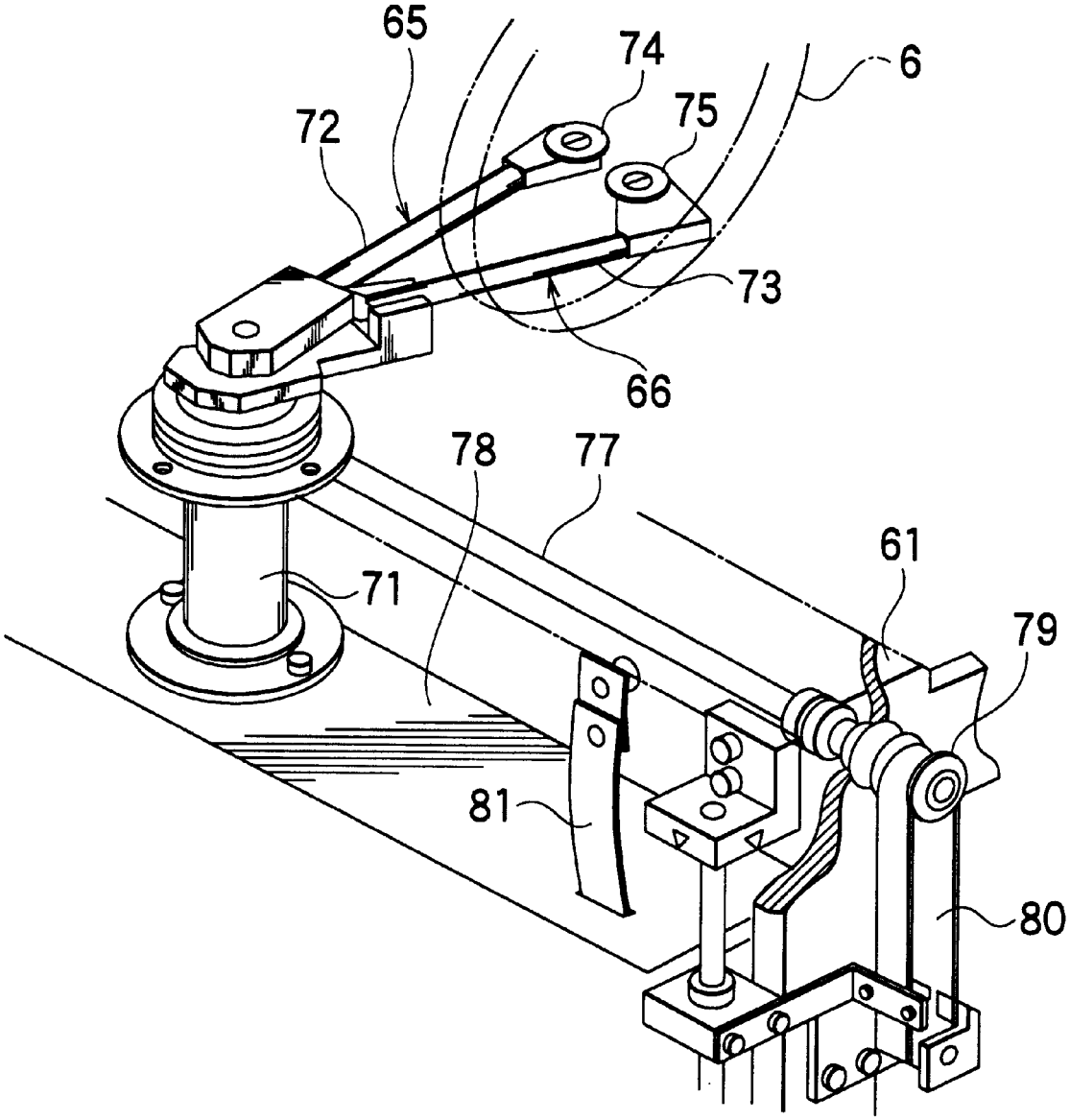
FIG. 5 is an oblique view showing the internal structure of the lens circumference measuring device of an aspect of an embodiment.

FIG. 5 is an oblique view showing the internal mechanism of measuring instrument receptacle 63. Movement shaft 77 is suspended between the left and right of table 61 so that it can freely turn and although the left side is not shown, belt 80 is looped on two pulleys 79 at the right and left of this movement shaft 77. Moreover, box 78, which is pulled down by two fixed load springs 81 (the left side is not illustrated), is made so that it can move up and down at the front of table 61.

Axle 71, which holds probes 65 and 66 at its top end face, is fastened to the top plate of box 78. The turning position of both right and left arms 72 and 73 of probes 65 and 66 here is controlled by their respective center axle that turn independently inside axle 71. Moreover, motors that turn arms 72 and 72 between the measuring position and the turned out position (not illustrated), encoders that detect the amount of movement of arms 72 and 73 in the axial direction of the lens (not illustrated), solenoid with an operating piece (actuator) that moves arms 72 and 73 to a specific angle at the measuring position (not illustrated), etc., are placed inside box 78 that moves up and down. In addition, freely turning feelers are at the ends of arms 72 and 73 of probes 65 and 66 so that they touch eyeglass lens 6.

Figure 6:
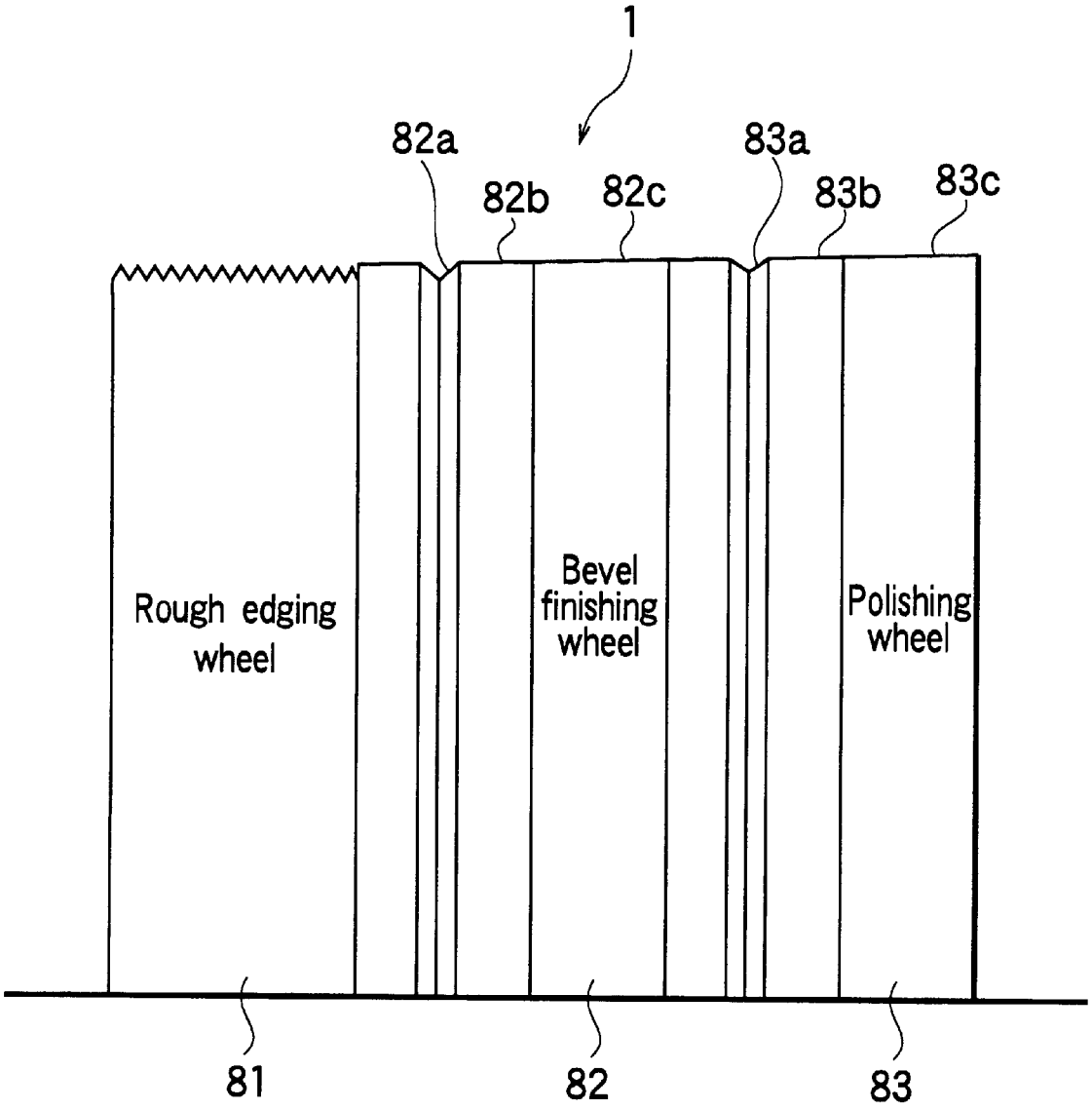
FIG. 6 is a structural diagram of a wheel from an aspect of an embodiment.

A structural diagram of above-mentioned wheel 1 is shown in FIG. 6. Wheel 1 of the lens polishing device has 3 wheels as one unit on the same axis, rough edging wheel 81 for rough machining that is cylindrical, bevel finishing wheel 82 for bevel polishing that forms a bevel in the lens end face after rough machining, or performs smooth machining, and polishing wheel 83 that gives the bevel face after bevel finishing and the lens end face after smooth machining a mirror polish. The wheel is fastened to spindle 5 (refer to FIG. 3) with a fastening screw.

Bevel finishing groove 82*a* and bevel polishing groove 83*a* are made in each circumferential surface of bevel finishing wheel 82 and polishing wheel 83. Moreover, the circumferential surface of the respective wheel 82 and 83 on both the right and left of bevel finishing groove 82*a* and bevel polishing groove 83*a* of bevel finishing wheel 82 and polishing wheel 83, respectively, is narrow on the left, which becomes the convex side of the eyeglass lens, and wide on the right, which becomes the concave side. If width of the flanks at the concave side of the eyeglass lens is wider than width of the flanks on the convex side of the eyeglass lens, the eyeglass lens is a strong lens with a thick end face. The circumferential surface to the right, which is the wide side, comprises smooth finishing face 82*c* and smooth polishing face 83*c*, respective so that smooth machining for finishing can be performed using bevel finishing wheel 82, while a mirror polish after this smooth finishing can be given with polishing wheel 83.

Circumferential surfaces to the left and right of bevel finishing groove 82*a* and bevel polishing groove 83*a* are not horizontal surfaces but rather inclined faces whose diameter is somewhat greater toward the left and right (in the axial direction). This is done in order to form a recess because the top rim part will touch the horizontal face of the end face other than the bevel shape in the case of frames with a large (deep) top rim part) such as combination frames (a plastic eyebrow part is attached to the metal frame eyebrow part). Moreover, right smooth finishing face 82*c* and smooth polishing face 83*c*, which are wider, have a small angle of inclination at a certain point and are almost horizontal (this point will be discussed later).

Rough edging wheel 81 (for instance, mesh: #50 to 150), bevel finishing wheel 82 (for instance, mesh: #400 to 600), and polishing wheel 83 (for instance, mesh: # 1000 to 4000) are controlled by, for instance, varying particle diameter of the wheel with the wheel diameter being constant, essentially without changing turning of the wheel during each process of rough machining, bevel formation, smooth machining and mirror-polishing in this embodiment. Furthermore, although only one type of bevel finishing wheel 82 and polishing wheel 83 is shown in the figure, there usually are several types of bevel's and there also several types of bevel finishing heels.

Figure 7:
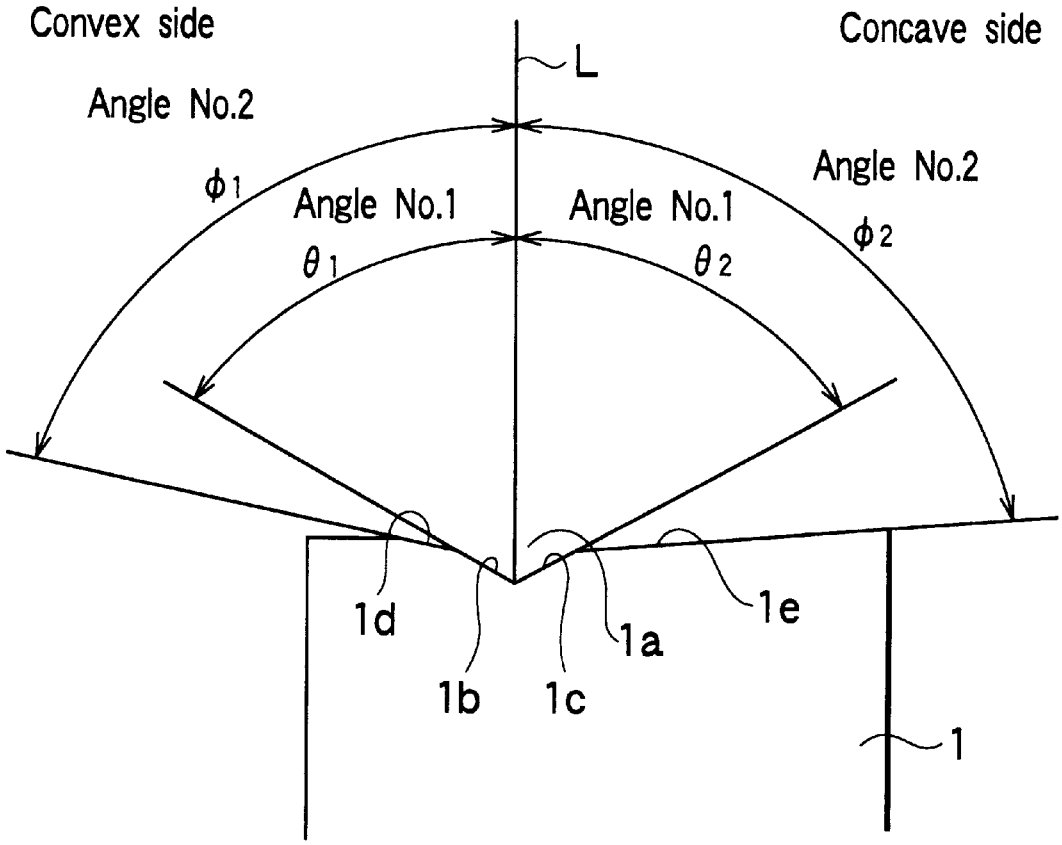
FIG. 7 is the structural diagram of the main parts of a bevel wheel of an aspect of an embodiment.

FIG. 7 shows a detailed diagram of the main parts of bevel-groove 1*a* and its circumferential end faces of wheel 1 that serves as both bevel finishing wheel 82 and polishing wheel 83. Bevel-groove 1*a* and its circumferential end faces are made at two angles called angle θ No.1 and angle ϕ No.2. Angles θ No.1 are called angle θ1 and θ2 and are formed from the corresponding 2 inclined faces 1*b* and 1*c* of bevel-groove 1*a*, which corresponds to the bevel in the eyeglass lens, and vertical line L drawn to the axis of wheel 1. Moreover, angles No.2 ϕ are called angles ϕ1 and ϕ2 and are formed from right and left inclined faces 1*d* and 1*e* in series with bevel-groove 1*a*, but outside bevel groove 1*a*, and horizontal line L. Angle No.2 ϕ is formed for the recess of the top rim part that was previously mentioned. Flanks 82*b* and 83*b* formed by this angle No. 2 have a boundary that is shown by the an imaginary line in FIG. 7.

Figure 8:
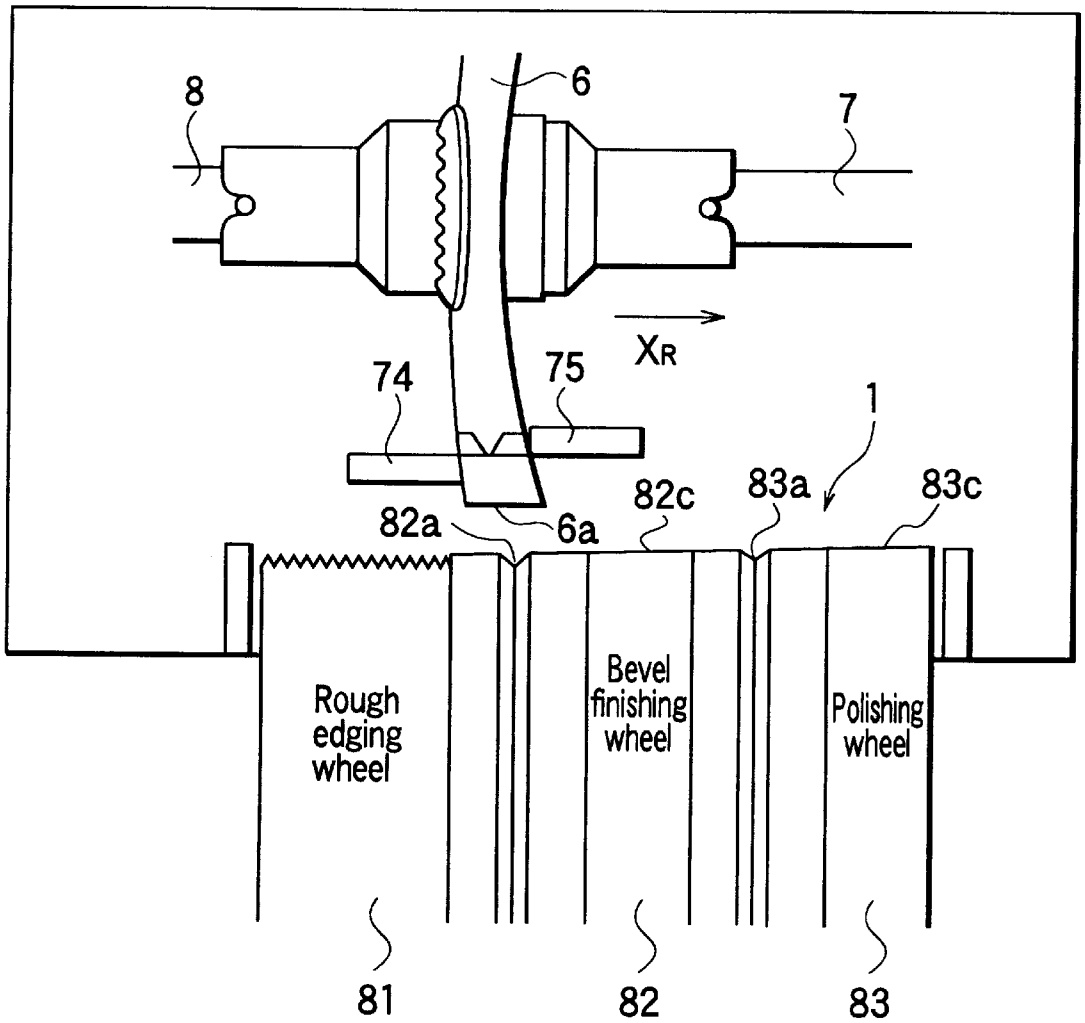
FIG. 8 is a diagram that explains machining of the end face of an eyeglass lens and lens measurement of an aspect of an embodiment.

As shown in FIG. 8, eyeglass lens 6 sandwiched by lens press axle 7 and lens support axle 8 is pressed against wheel 1 and gradually moved from the left to the right as shown by arrow XR toward the right in an axial direction when the end face of eyeglass lens 6 is to be edged using a wheel with rough edging wheel 81, bevel finishing wheel 82 and polishing wheel 83 continuous on one axis as shown in FIG. 8. Thus, rough machining, bevel finishing and bevel polishing to a mirror polishing are performed in succession. When smooth machining is performed without the bevel, bevel-finishing groove 82*a* is passed over after rough machining and [the lens] is pressed against smooth finishing face 82*c* and smooth polishing face in succession. Furthermore, eyeglass lens 6 can be pressed against wheel 1 or wheel 1 can be pressed against eyeglass lens 6. Determination of the position around the entire edge of eyeglass lens 6 is performed during each mode of automatic bevel formation, forced bevel formation, and smoothing by bringing feelers 74 and 75 of lens edge determination device 53 (refer to FIG. 5) into contact with eyeglass lens 6, as shown in FIG. 8.

Figure 9:
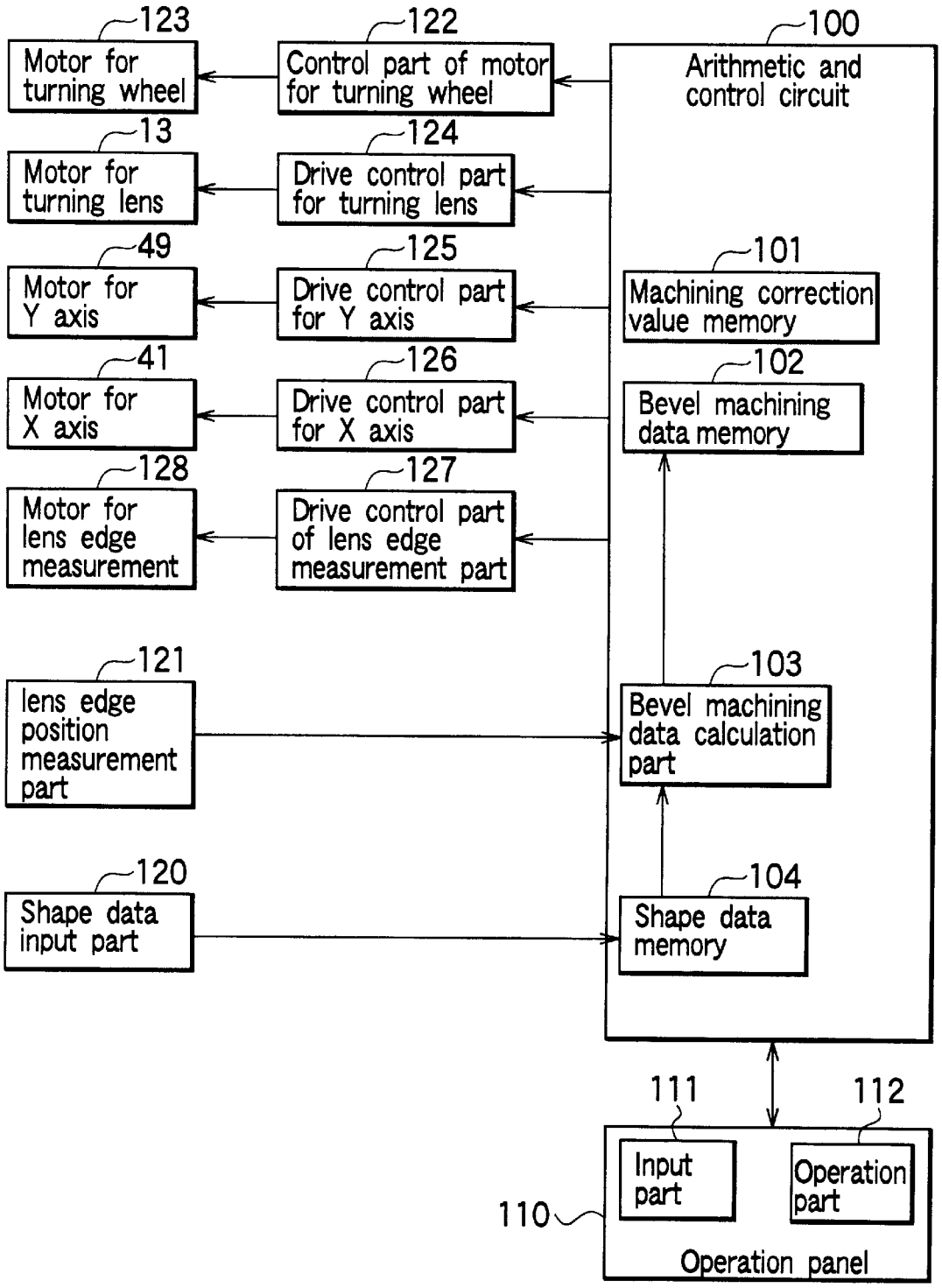
FIG. 9 is a structural diagram showing the electrical control system for conducting the method of machining the end face of an eyeglass lens of an aspect of an embodiment.

FIG. 9 shows an electric device structure for conducting the above-mentioned method of finishing the end face of above-mentioned eyeglass lens 6. In FIG. 9, 100 is the arithmetic and control unit that performs various operations for finishing the end face and controls [the procedure] based on data obtained by these operations and is made from computers. Lens edge position determination part 121 and shape data input part 120 are set up as the input parts. Moreover, there is operating panel 110 and when operating part 112 of operating panel 110 is operated, rough machining, test finishing and smooth finishing, polishing, etc., are conducted in accordance with the operating details Moreover, operation data, such as the design values, etc., are input from input part 111 of operating panel 110 to arithmetic and control unit 100.

By means of bevel machining and bevel mirror polishing (simply referred to below as bevel machining), various data are needed for eyeglass lens 6 and its end face, as previously explained, and shape data that has accumulated from shape data input 120 is stored at once in shape data memory 104 of arithmetic and control unit 100. The stored shape data is read out to data processing section 103 for bevel machining and processed with the lens edge date that has been input from lens edge position measurment part 121, and the bevel machining data that are the operation results are stored in data memory 102 for bevel machining. Data memory 102 for bevel machining is the memory that stores the control data for the machining that is given to X axis motor 41. The control data differ with the type of bevel. When the wheel has several bevel's (large bevel's, small bevel's), the position of the bevel can be selected by moving in the direction of the X axis based on the control data. For example, there are different bevel's for plastic frames and metal frames, a large bevel being formed in the wheel for plastic frames and a small bevel being formed in the wheel for metal frames.

There is correction value memory 101 for machining that gives control data to Y axis motor 49 in arithmetic and control unit 100. This correction value memory 10 for machining is a memory in which is stored the necessary correction data in accordance with the type of eyeglass lens and material used for the frame. The correction data vary depending on whether or the type of eyeglass lens is glass or plastic or it is necessary to adjust edging pressure. Furthermore, edging performance varies with the type of plastic used in plastic lenses and therefore, different correction data are needed. Moreover, the standing direction of the bevel is different, depending on whether the frame is made of metal or celluloid system, it is rimless, etc., and since the diameter of the bevel mirror polish varies with this difference, it is necessary to use the correction data in accordance with these differences.

The control data of arithmetic and control unit 100 is given to motor 123 for turning the wheel via part 122 for controlling the motor that turns the wheel or to motor 13 for turning the lens via drive and control part 124 for turning the lens. Moreover, control data is given to Y axis motor 49 via Y axis drive and control part 125, X axis motor 41 via X axis drive and control part 126, and motor 128 for determination of the lens edge via drive and control part 127 of the lens edge determination part.

Figure 10:
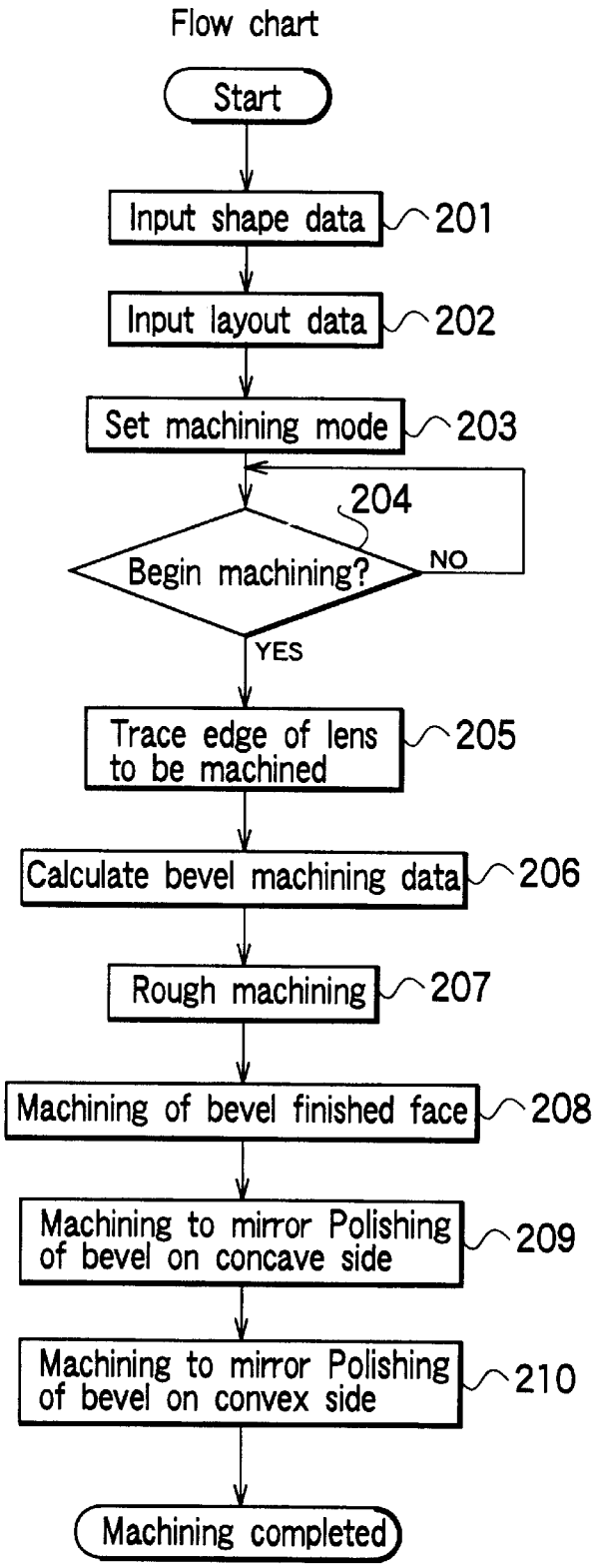
FIG. 10 is a flow chart explaining the method of finishing the end face of an eyeglass lens of an aspect of an embodiment.

Next, the procedure of bevel machining, including bevel mirror polishing, is explained beginning with shape data input using the flow chart in FIG. 10.

The eyeglass frame that has been selected by the customer at the optometrist's is measured with, for instance, a three-dimensional eyeglass frame determination device along the lens rim groove. After completing the measurement, the shape data that has been determined (ri, i, xi) are input to arithmetic and control circuit part 100 from the shape data input part 120 of the above-mentioned device (step 201). Actually, frame tracing of the eyeglass frames, pattern tracing of rimless types without a frame, or lens tracing along the edge of the eyeglass lens is performed and the shape data (two-dimensional and 3-dimensional) obtained from this is input through shape data input part 120 to shape data memory 104.

Then layout data for the eyeglass lens are input (step 202). It is necessary to set the following machining conditions when inputting layout data. The machining conditions including selection of the type of edge glass, plastic (plastic lenses normally with good edging performance such as allyl and polyurethane type and special plastics with poor edging performance (polycarbonate, acrylic)), selection of the frame material (celluloid, metal type), frame PD (pupil distance (FPD, DEL) input, PD (binocular, monocular) input, horizontal eccentricity X input, vertical eccentricity Y (Y, EPH, BXH) input, astigmatism axis Ax input, finished size input, etc.

The machining mode is then set(step 203). As previously mentioned, there are 3 types of edging and machining, automated bevel edging, forced bevel edging and flat edging. Moreover, mirror polishing can be set for each. When automatic is selected, the position where the bevel stands on the end face of the eyeglass lens is automatically determined. The position where the bevel is made can be changed by a specific procedure. When forced is selected, the bevel can be made at any position. When flat is selected, flat edging can be performed without making a bevel.

After selecting the machining mode (step 203), the machine waits until the machining start button is pushed on operating panel 110 (step 204) and when machining starts, motor 128 for measuring the lens edge is started and the edge of the eyeglass lens is traced (step 205). This edge tracing is performed by lens edge measurement device 63 in FIGS. 4 and 5 that was previously described. The edge positions around the entire lens corresponding to the look of the frame shape data are actually measured here. The measurements are input from lens edge position measurement part 121 to data processing part 103 for bevel machining of arithmetic and control unit 100. Various data for bevel machining (Ri, i, Xi) are processed by conventional methods by data processing part 103 for this bevel machining to which the lens edge position determinations (data of the convex surface shape and the concave surface shape of the lens including the direction of the X axis) and shape data (frame data) have been added (step 206).

Next, end face machining of the eyeglass lens in order to fit eyeglass lens 6 into the rims of the eyeglass frames is performed based on the data for bevel machining obtained by processing, in order to do this, the end face of eyeglass lens 6 is rough machined using rough edging wheel 81 (step 207). That is, chucking motor 9 is turned on and eyeglass lens 6 is brought to the desired place in FIG. 3 by lens support axle 8 and lens push axle 7. X axis motor 41 and Y axis motor 49 are turned on and eyeglass lens 6 is pressed to rough cutting wheel 81 of wheel 1 under a specific pressure based on the trace data. Motor 123 for turning the wheel is driven by control part 122 of the motor that turns the wheel and wheel 1 is turned, and motor 13 for turning the lens is driven and eyeglass lens 6 is turned. Thus, rough finishing of the end face of eyeglass lens 6 is performed based on the trace data.

Next, bevel finishing is performed (step 208). Finishing is performed while giving the position of the apex of the bevel-notch and data of the bevel curve. By means of the present example, bevel finishing is performed with the apex position of the bevel-notch in the lens end face remaining constant at the ratio between the front and back edges in the direction of end face width (lens thickness) and apex of the bevel-notch that was originally set and designed (for instance, 6:4 or 7:3). In order to make a bevel in the end face of the eyeglass lens, bevel curves (for instance, 4 to 7 curves) must be selected, but the details of how to select the bevel curve will not be discussed here.

During bevel finishing, it is necessary to control X axis motor 41 as it is being driven based on the bevel machining data processed in step 206 so that the apex position of the bevel-notch after machining and the deepest part of the bevel-groove of wheel 1 coincide. Consequently, Y axis motor 49 is driven and eyeglass lens 6 is moved from wheel 1 by a specific amount in order to move eyeglass lens 6 that has been rough machined in step 207 away from wheel 1 temporarily.

Next, X axis motor 41 is turned a specific amount and eyeglass lens 6 is moved to the position of the wheel for bevel machining. Then Y axis motor 49 is driven and carriage 24 is lowered and eyeglass lens 6 is pressed against wheel 1. The motor for turning the wheel is turned on and wheel 1 is turned, and lens motor 13 is turned on and eyeglass lens 6 is turned. X axis motor 41 is driven while being controlled based on the data for bevel machining processed in step 206. Thus, bevel machining is performed.

Once machining of the bevel finished face has been completed, the bevel finished lens is ground to a mirror polish to maker the white, non-transparent bevel faces transparent. In this case, there is a difference in how the two inclined faces of the bevel are given a machine finish when both inclined faces of the bevel are simultaneously machined by polishing wheel 83 with a bevel-groove that corresponds to the bevel. The inventors discovered that the reason for this is that the apex position of the bevel-notch is curved at the edge thickness in the direction of circumference and the convex side of the lens firmly hits the mirror polishing wheel during polishing. Therefore, in this embodiment, bevel mirror polishing (bevel polishing) is performed in 2 steps, on the bevel on the concave side and on the bevel on the convex side, by controlling the finished lens in the direction of the X axis so that there is not a difference in how the two inclined faces of the bevel are finished and the extent of the mirror polish.

However, when polishing of the bevel is performed in two steps in this way, it is necessary to make some difference in X axis control of the finished lens between lenses that have good edging performance, such as DEL type lens, and hard lenses with poor edging performance, such as polycarbonate type lenses.

(A) bevel polishing of allyl finished lenses (FIGS. 1A through 1D)

"0.0 mm" is pre-stored in correction value memory 101 for machining of arithmetic and control unit 100 as the correction data for lenses with good edging performance. End face polishing allowance 175 of finished lens 76 is 0.1 mm. First, bevel mirror polishing on the concave side of finished lens 76 is performed (step 209).

(1) Start polishing

Figure 1A:
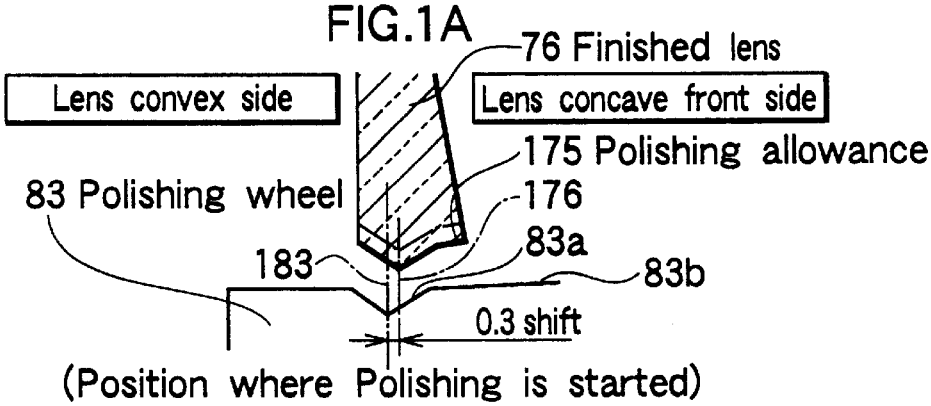
FIGS. 1A, 1B, 1C and 1D are process diagrams of the method of bevel polishing and edging of an aspect of an embodiment.

X axis motor 41 is turned on and finished lens 76 is moved by a specific amount to the right to the concave side of finished lens 76 so that bevel apex position 176 of finished lens 76 will be displaced by a specific amount (for instance, 0.3 mm) to the right from the bevel-groove center position (base position of the bevel-groove) 193 of polishing wheel 83 (FIG. 1A). Consequently, when edging is started, bevel apex position 176 and bevel-groove center position 183 do not coincide.

(2) First polishing

Figure 1B:
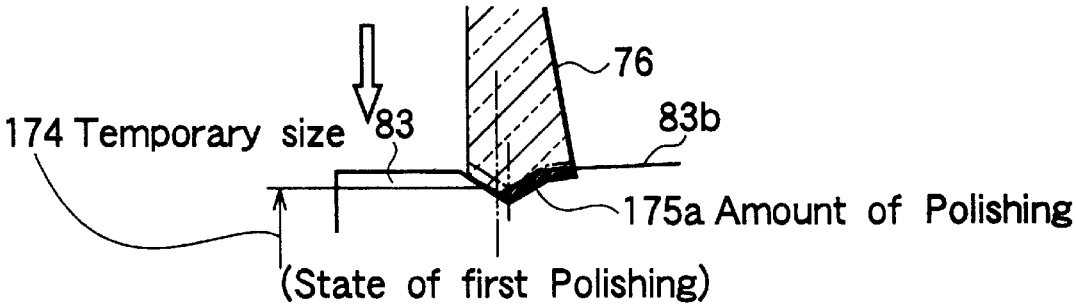

Y axis motor 49 is turned on and carriage 24 is lowered in the direction of the large arrow pointing down and finished lens 76 falls to the position of temporary size 174, where polishing allowance (hatched cut part) 175 on the concave side of finished lens 76 is cut from above-mentioned polishing allowance 175 (FIG. 1B). Part of the polishing allowance on the convex side of finished lens 76 is also cut at this time. Then bevel mirror polishing is performed on the convex side (step 210).

(3) Second polishing

Figure 1C:
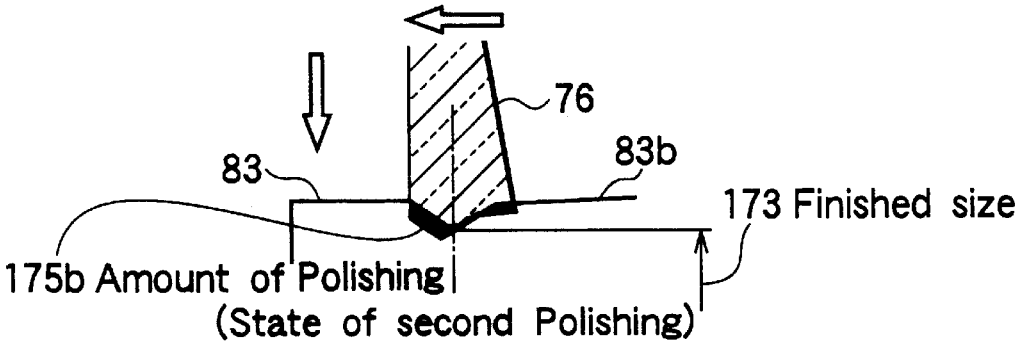

X axis motor 41 is turned on and the bevel polishing position is returned 0.2 mm in the direction shown by the white arrow pointing left so that bevel apex position 176 and the bevel-groove center position coincide, Y axis motor 49 is turned on and finished lens 76 is lowered in the direction shown by the white arrow pointing down and machining allowance 175*b* on the convex side of finished lens 76 and remaining polishing irregularities are cut (FIG. 1C).

(4) Completion of polishing

Figure 1D:
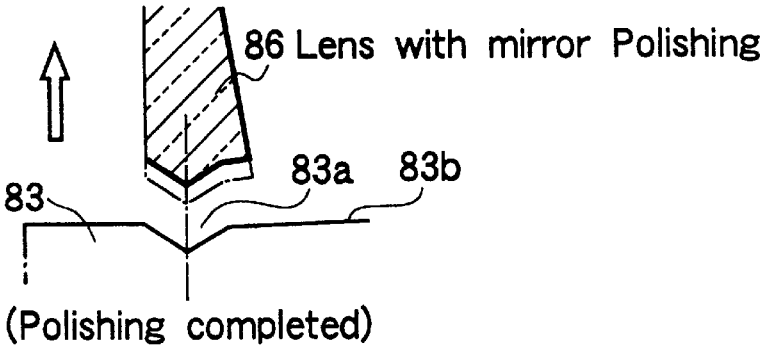

Y axis motor 49 is turned on and carriage 24 is raised in the direction shown by the white arrow pointing up and lens 86 is released from wheel 1. As a result, mirror-polished lens 86 where the bevel has been machined to a mirror polish is finished (FIG. 1D).

Figure 2:
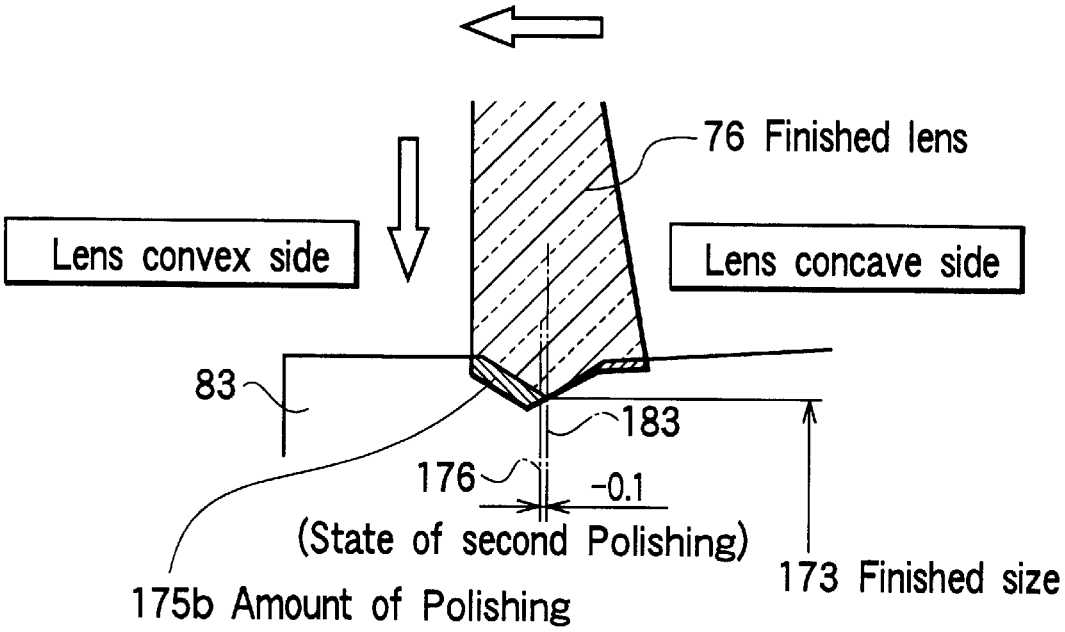
FIG. 2 is a process diagram of the main parts of the bevel polishing and edging method of another aspect of an embodiment.

(B) Bevel polishing of polycarbonate type finished lenses (FIG. 2).

"−0.1 mm" is pre-stored in machining correction value memory 101 of arithmetic and control circuit part 100 as the correction data for polycarbonate type lenses.

(1) Start polishing

The method of bevel polishing is the same as previously described in (A) (1).

(2) First polishing

The method of bevel polishing is the same as previously described in (A) (2).

(3) Second polishing

X axis motor 41 is turned on and finished lens 76 is moved in the direction shown by the white arrow pointing left to the convex side of finished lens 76 in order to displace apex position 176 of the bevel of finished lens 76 a specific amount (for instance, 0.1 mm) from bevel-groove center position 183 of polishing wheel 83 and pressed firmly against polishing wheel 83. Then Y axis motor 49 is turned on and finished lens 76 is lowered in the direction of the white arrow pointing down to position 173 at the finished size. As a result, polishing allowance 175*b* and remaining polishing irregularities in the convex side of polished lens 76 are efficiently cut (FIG. 2)

(4) Completion of polishing

Mirror polishing is the same as in (A) (4).

As previously explained by above-mentioned (A) and (8), the 2 bevel faces are not simultaneously polished by the bevel mirror-polish machining in the embodiment, but rather, polishing is divided into 2 steps, polishing of the bevel face on the concave side and polishing of the bevel face on the convex side and in this case, the polished lens is controlled in the direction of the X axis so that polishing allowance will not remain and the position of the bevel is not lost. Therefore, high-precision machine polishing without any polishing allowance remaining is possible, even if the locus of the bevel apex is curved, etc. As a result, a transparent bevel finished surface that does not remain white is obtained.

Furthermore, by means of the above-mentioned embodiment, the concave side of the 2 bevel faces is polished first and then the inclined face of the bevel on the convex side is polished when the bevel is being mirror polished. This is done because in the case of the polished lens in the illustrated example (ordinary meniscus lens), the apex of the bevel is displaced to the convex side in the direction of edge thickness and flat places that protrude from the frame easily can be present on the concave side of the bevel faces. Therefore, the side on the flat part is polished first so that there will be no polishing residue at the edge on the convex side of the bevel faces.

Figure 11:
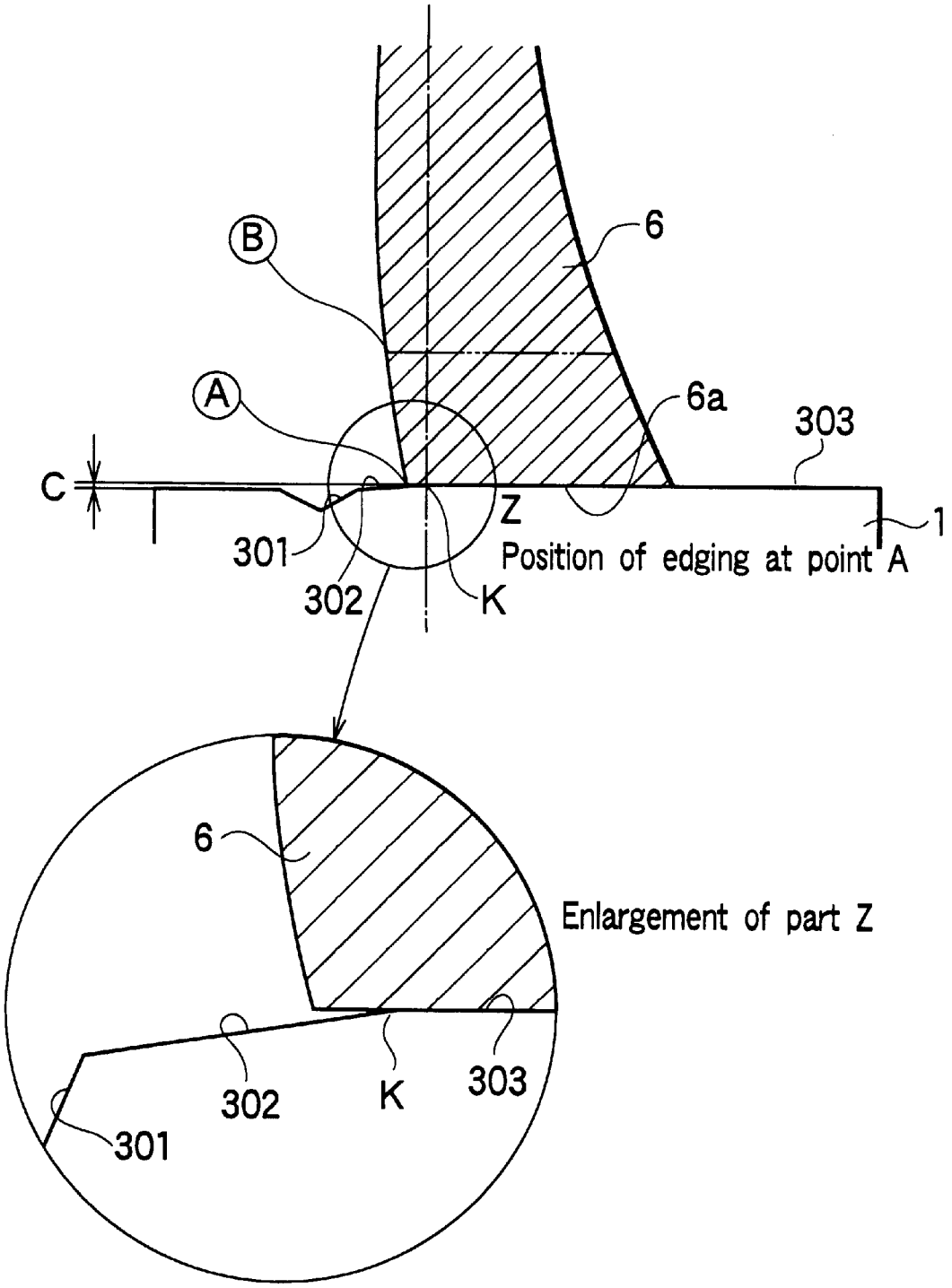
FIG. 11 is a diagram explaining a conventional method of smooth finishing.

The embodiment that is described next solves the problems associated with finishing precision and making fashionable glasses that accompany the formation of streaks shown in above-mentioned FIG. 11 and a large device. The conventional flat finishing faces, which are horizontal, have a specific angle with respect to the X axis so that they will have the same angle No. 2, which forms the flanks, in order to prevent streaks from the boundary [between the faces] from being made in the end face of the eyeglass lens during flat edging or machining to a mirror polish that is carried out after flat edging (simply referred to below as flat edging). Furthermore, the terms supplementary angles No. 1 and No. 2 corresponding to angles No. 1 and No. 2, and further, supplementary angle No. 3, are defined here.

Figure 12:
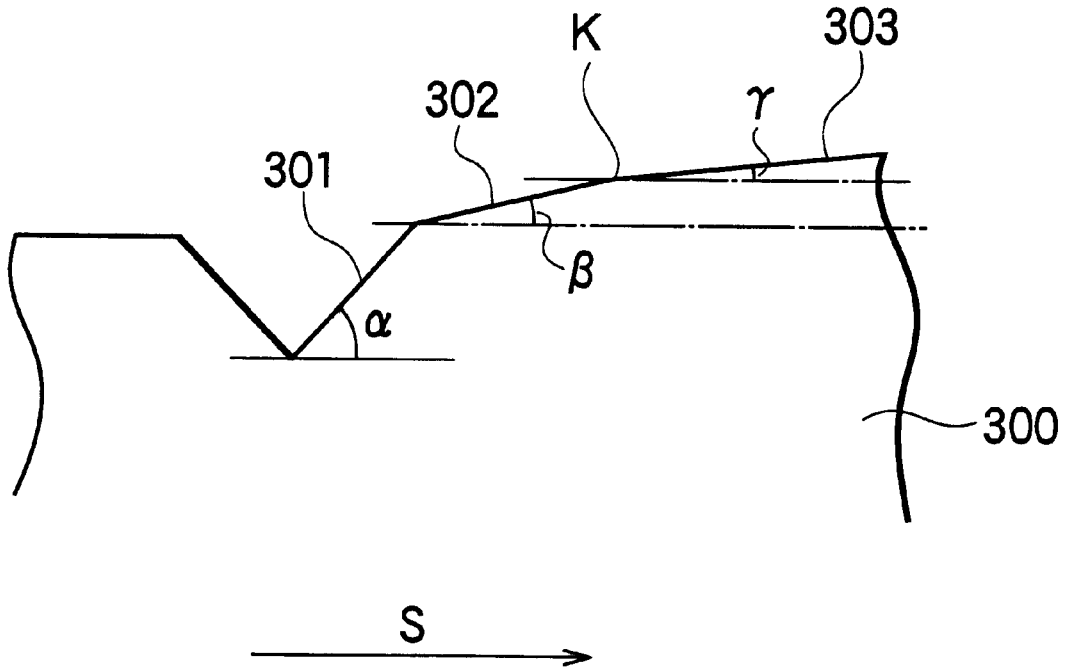
FIG. 12 is a diagram explaining the main parts of a grind stone used for smooth finishing of an aspect of an embodiment.

As shown in above-mentioned FIGS. 6, and 12 wheel 1 has rough edging wheel 81, bevel finishing wheel 82, and polishing wheel 83 on the same axis. Of these, bevel finishing wheel 82 and polishing wheel 83 have in common groove inclined face 301 for bevel machining, which has supplementary angle α No. 1 in axial direction S, flanks 302 for the top rim of the frame continuous with said groove inclined faces 301, which has supplementary angle β No. 2 that is smaller than above-mentioned supplementary angle α No. 1 in the axial direction S, and flat finishing face 303 for flat edging, which is continuous with said flanks 302, in the axial direction S of the circumferential surface of the wheel, as shown in FIG. 12. Moreover, flat finishing face 303 has supplementary angle γ No. 3 with respect to axial direction S of wheel 300 that is smaller than supplementary angle No. 2 of flanks 302. Flat edging as a rule involves edging on horizontal faces. However, there are no problems with edging on inclined faces as long as their angle of inclination is gentle. Therefore. flat finishing face 303 that is inclined by supplementary angle γ No. 3, which is smaller than supplementary angle β No. 2, is formed. The boundary between this flank 302 and flat finishing face 303 is called boundary K.

Actually, if supplementary angle β No. 2 is, for instance, 4° with respect to axial direction S, supplementary angle γ No. 3 of flat finishing face 303 will also be 2° with respect to the axial direction and the difference between supplementary angle β No. 2 and supplementary angle β No.3 will be very small. When this difference between the angles is this small, essentially no stripes or streaks from the boundary between the flank and flat finishing face will be made in the end face of the eyeglass lenses, even if the end face of the eyeglass lens protrudes from boundary K.

incidentally, even if the difference between the angle of inclination of the flanks and the flat finishing face is very small and the angle of inclination at the boundary between the flank and the flat finishing face is such that they can be continuous and no stripes from the boundary are made in the end face of the eyeglass lens, there is an angle present at the boundary and the formation of stripes cannot be completely avoided. However, with regard to this point, as long as the position of the eyeglass lens in the direction of the X axis is controlled during flat edging so that the apex of the end face on the convex side of the eyeglass lens does not pass the boundary, the flat finishing face can be a conventional horizontal face that does not have an angle of inclination.

Moreover, since there is no change in terms of the extra width given to the flat finishing face, even if the end face of the eyeglass lens is flat edged with a flat finishing face that also has supplementary angle No. 2 forming the flank, and therefore, width of wheel 1 increases by as much as the extra width that is provided and as a result, the polishing machine is also larger. However, with respect to this point as well, it is not necessary to give the wheel extra width as long as the eyeglass lens is controlled in the direction of the X axis so that it is usually adjacent to the boundary but does not pass the boundary.

Figure 13A:
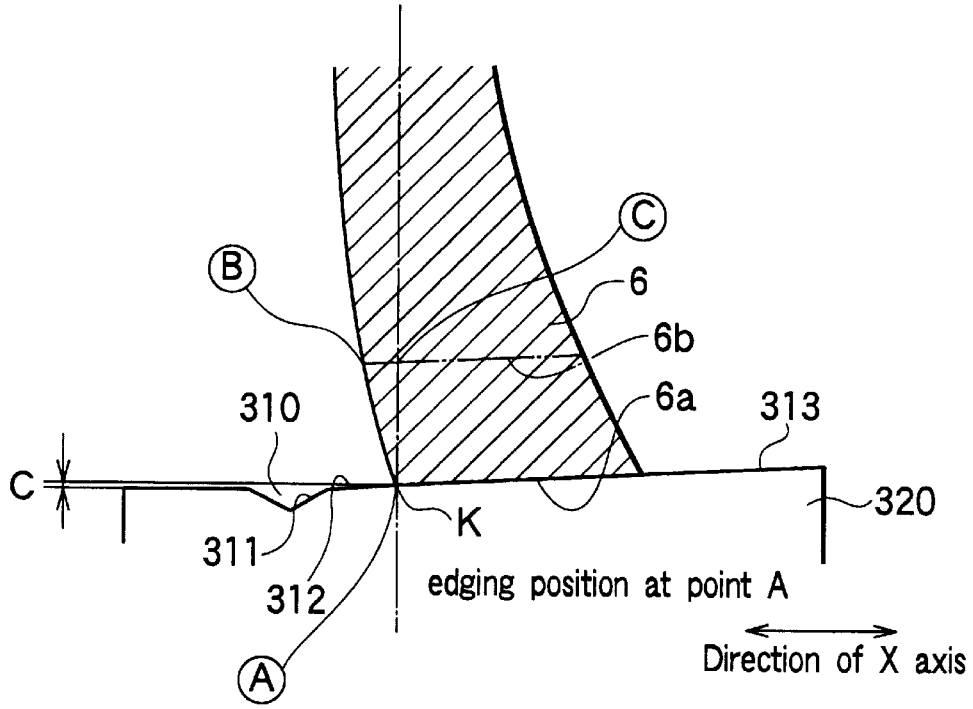
FIGS. 13A and 13B are diagrams of the process explaining the method of smooth finishing of an aspect of the embodiment
Figure 13B:
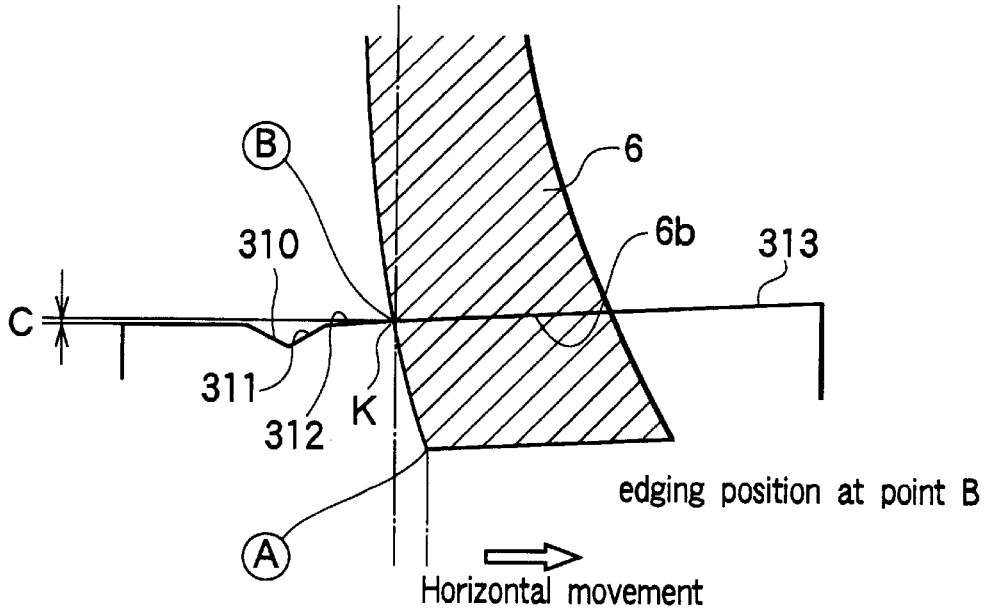

Therefore, an embodiment that takes into consideration the above-mentioned points will be described using polishing wheel 320 in FIGS. 13A and 13B. Furthermore, 311 in the same figure is the groove inclined face of bevel polishing groove 310, 312 is the flank, and flat polishing face 313 has the previously described supplementary angle γ No. 3. Moreover, boundary K is the reference position (reference point or reference line) of the present invention and becomes the boundary position (boundary point or boundary line). Furthermore, the shape data of these wheels were obtained by incorporating data with the machining data as the position data.

Figure 14:
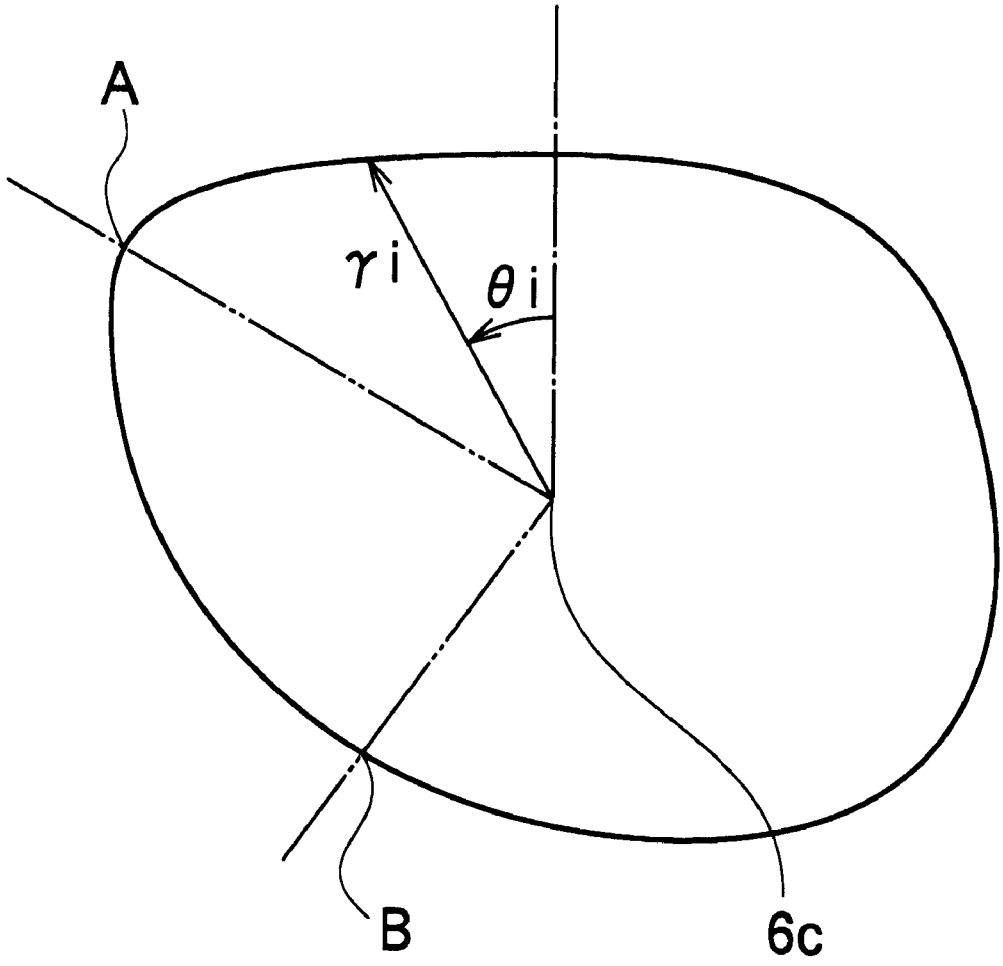
FIG. 14 is a diagram of the relationship between the position of the angle of rotation of the lens axis and the distance from the lens end face after rough polishing of an embodiment.

X axis motor 41 is turned on and carriage 24 is moved in the direction of the X axis so that apex A of end face 6*a* on the convex side of eyeglass lens 6 matches point K at the boundary of wheel 320, which is shown by an imaginary line, as shown in FIG. 3. Next, Y axis motor 49 turned on and carriage 24 is lowered and eyeglass lens 6 is pressed to wheel 320 (FIG. 13A). Referring to FIG. 14, the shape of the eyeglass lens (for instance, a lens with lens power of a meniscus lens shape) is approximately the frame shape and the distance from lens axis center 6*c* to lens end face after rough edging (ri) varies with the position of the angle of rotation (θi) of the lens axis. The apex position of the end face on the convex side where the distance between this lens axis center 6*c* and the lens end face after rough edging is longest serves as A and the apex position of the end face on the convex side in the direction where this distance is shortest serves as B (refer to FIG. 14). Thus. X axis motor 41 is turned on and carriage 24 moves in the direction of the X axis so that origin A of end face 6*a* on the convex side of eyeglass lens 6 matches point K at the boundary line on wheel 320, which is shown with an imaginary line, as shown in FIG. 13. Next, Y axis motor 49 is turned on and carriage 24 is lowered and eyeglass lens 6 is pressed to wheel 320. Then when the lens end face is kept pressed to wheel 320 and the lens end face that includes apex B is pressed to lens 320 while turning around the lens axis, position K is kept relatively on the inside of the lens end face because the lens is meniscus in shape. Consequently, in order to avoid this, movement of eyeglass lens 6 by X axis motor 41 is controlled in the direction of the X axis in synchronization with the turning of the lens axis (i) while correcting this movement so that the end face on the convex side of eyeglass lens 6 and point K relatively coincide.

Thus, when the position of eyeglass lens in the direction of the X axis is controlled so that apex A of the end face on the convex side of eyeglass lens 6 is usually pressed against boundary K of flat polishing face 313 of wheel 320, eyeglass lens 6 will not pass boundary K and no strips or streaks will be made by boundary K in the end face of eyeglass lens 6. Moreover, since the locus of apex A of the end face on the convex side is controlled so that boundary K passes continuous over the boundary of wheel 320 in the circumferential direction, an extra long smooth face 313 is not necessary. As a result, width of wheel 320 can be reduced. Moreover, there is not strictly 1 point for the boundary point K in controlling boundary point K of the wheel in the direction of the X axis of the lens in the present specification, and this boundary point can be defined to include positions around this point as long as the effects of the present invention are not lost.

The reduction in width of the polishing wheel that was previously described can be similarly applied to the case of a bevel finishing wheel.

Actually, it was possible to reduce width of the flat edging face (flat finishing face and flat polishing face), including the bevel part, which originally was 24 mm, to 20 mm on the finishing wheel and to 20 mm on the polishing wheel.

By means of the above-mentioned embodiment, no stripes from the boundary are made in the end face of the eyeglass lens, even if there is no extra width to the wheel, and finished precision in machining of the end face of an eyeglass lens is uniform. Moreover, because width of the wheel can be reduced, polishing wheel 83 can also be used in series, even if the wheel width is not markedly increased.

Furthermore, by means of the above-mentioned embodiment, the X axis was controlled so that the apex of the end face on the convex side would usually coincide with boundary K, but it is possible to prevent stripes from boundary K from being made in the end face by freely controlling the X axis so that it does not pass only boundary K as long as it is within flat polishing face 313. Moreover, each motor used in the embodiment can be a stepping motor. The embodiment described a minus lens. However, the present invention can be similarly applied to a plus lens.

We claim:

1. A method for machining an end face of a spectacle lens having a bevel formed in the end face, the bevel having at least a first and a second inclined face, the method comprising:

moving an apex position of the bevel on the end face of the spectacle lens from an original position that approximately coincides with a center position of a bevel-groove of a bevel polishing wheel, towards a back side of the spectacle lens, and polishing a back side portion of the bevel to a polishing allowance using the bevel polishing wheel with the bevel-groove, wherein the shape of a portion of the bevel-groove substantially mates with the bevel; and returning the spectacle lens to the original position so that the apex position of the bevel in the end face of the spectacle lens approximately coincides with the center position of the bevel-groove in said bevel polishing wheel, and polishing a front side portion of the bevel to a polishing allowance.

2. The method for machining an end face of a spectacle lens according to claim 1, wherein polishing the front side portion of the bevel comprises:

slightly displacing the apex position of the bevel from the original position towards the front side portion of the bevel and pressing the spectacle lens firmly to said wheel surface.

3. The method for polishing a spectacle lens according to claim 2, wherein said spectacle lens is a polycarbonate lens.

4. The method for machining an end face of a spectacle lens according to claim 2, wherein a correction value corrects the displacement of said apex position of said spectacle lens in accordance with a material of said spectacle lens.

5. The method for machining an end face of a spectacle lens according to claim 1, wherein:

said spectacle lens is a diethylene glycol bis allyl carbonate lens; and wherein polishing the front side portion of the bevel when the apex position of the bevel substantially coincides with the center position of the bevel-groove of the bevel polishing wheel.

6. The method for machining an end face of a spectacle lens according to claim 1, wherein said spectacle lens is displaced relative to said wheel by moving said spectacle lens.

7. A method for machining an end face of a spectacle lens, comprising:

pressing the end face of said spectacle lens to a wheel having a planing face;

turning said spectacle lens around an X axis; and machining the end face of said spectacle lens with the planing face of said wheel, wherein said spectacle lens has a convex and a concave, wherein a position of said spectacle lens in the direction of the X axis, defined by an axial length of said spectacle lens, is controlled so that an apex position, defined by the intersection of the end face and the convex of said spectacle lens, does not move past a reference position on said wheel, and wherein the position of said spectacle lens in the direction of the X axis, is controlled by correcting the apex position which changes with said turning, so that the apex position coincides with the reference position on said wheel in synchronization with said turning.

8. The method for machining an end face of a spectacle lens according to claim 7, wherein said wheel comprises:

a bevel-groove that substantially mates with a bevel in the end face of the spectacle lens; and wherein said planing face is disposed outwardly and continuous with the bevel-groove and wherein the reference position on said wheel is a boundary position located between said bevel-groove and said planing face.

9. The method for machining an end face of a spectacle lens according to claim 7, wherein said wheel comprises:

at least one bevel-groove similar to the shape of a bevel in the end face of the spectacle lens;

at least a pair of flanks located outwardly and in series with the bevel-groove; and said planing face is located outwardly and in series with the flanks, and the reference position on said wheel is a boundary position between said flanks and said planing face.

10. The method for machining an end face of a spectacle lens according to claim 9, wherein:

said wheel is a bevel finishing wheel with which the end face of said spectacle lens is finished, said bevel-groove is a bevel-finishing groove, and said planing face is a flat finishing face.

11. The method for machining an end face of a spectacle lens according to claim 9, wherein:

said wheel is a polishing wheel that machines a finished end face of said spectacle lens to a mirror polish, said bevel-groove is a bevel polishing groove, and said planing face is a flat polishing face.

12. The method for machining an end face of a spectacle lens according to claim 9, wherein said wheel integrally comprises:

a bevel finishing wheel portion that finishes the end face of said spectacle lens; and a polishing wheel portion that machines the finished end face of said spectacle lens to a mirror polish.

13. The method for machining an end face of a spectacle lens according to claim 9, wherein said wheel comprises:

an axis disposed along an axial length of the wheel, said bevel-groove of said wheel is formed circumferentially about the axis wherein the bevel-groove has a first and a second inclined face disposed at a first angle of inclination with respect to the axis of said wheel;

said flanks of said wheel are located, outwards of, and continuous with said inclined faces of said bevel-groove and have a second angle of inclination with respect to the axis of said wheel that is smaller than said first angle of inclination; and said planing face of said wheel is located outwards of, and continuous with said flanks and has a third angle of inclination with respect to the axis of said wheel that is smaller than said second angle of inclination.

14. The method for machining an end face of a spectacle lens according to claim 12, wherein said bevel finishing wheel portion comprises:

a bevel finishing groove similar to the shape of a bevel in the end face of the spectacle lens;

a pair of bevel finishing flanks located outwardly and in series with the bevel finishing groove; and a flat finishing, face located outwardly and in series with the flanks, and the reference position on said wheel is a boundary position between said bevel finishing flanks and said flat finishing face.

15. The method for machining an end face of a spectacle lens according to claim 14, wherein:

said bevel finishing groove in said bevel finishing wheel portion is made from a first and a second inclined face disposed at a first angle of inclination with respect to an axis disposed along an axial length of the bevel finishing wheel portion;

wherein said bevel finishing flanks of said bevel finishing wheel portion are located outwardly and continuous with said bevel finishing groove and having a second angle of inclination with respect to the axis of said bevel finishing wheel portion that is smaller than said first angle of inclination; and wherein said flat finishing face of said bevel finishing wheel portion is located outwardly and continuous with at least one of said bevel finishing flanks and having a third angle of inclination with respect to the axis of said bevel finishing wheel portion that is smaller than said second angle of inclination.

16. The method for machining an end face of a spectacle lens according to claim 12, wherein said polishing wheel portion comprises:

a polishing groove similar to the shape of a bevel in the end face of the spectacle lens;

a pair of polishing flanks located outwardly and in series with the polishing groove; and a flat polishing face located outwardly and in series with the polishing flanks, and the reference position on said wheel is a boundary position between said polishing flanks and said flat polishing face.

17. The method for machining an end face of a spectacle lens according to claim 16, wherein:

said polishing groove in said polishing wheel portion is made from a first and a second inclined face disposed at a first angle of inclination with respect to an axis disposed along an axial length of the polishing wheel portion;

wherein said polishing flanks of said polishing wheel portion are located outwardly and continuous with said polishing groove and having a second angle of inclination with respect to the axis of said polishing wheel portion that is smaller than said first angle of inclination; and wherein said polishing face of said polishing wheel portion is located outwardly and continuous with at least one of said polishing flanks and having a third angle of inclination with respect to the axis of said polishing wheel portion that is smaller than said second first angle of inclination.

* * * * *